US009259949B2

(12) United States Patent
Otsuka et al.

(10) Patent No.: US 9,259,949 B2
(45) Date of Patent: Feb. 16, 2016

(54) LIQUID DISCHARGING APPARATUS AND CONTROL METHOD THEREOF

(71) Applicant: Seiko Epson Corporation, Tokyo (JP)

(72) Inventors: Shuji Otsuka, Shiojiri (JP); Isao Nomura, Azumino (JP); Hidenori Usuda, Matsumoto (JP); Toru Matsuyama, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/705,234

(22) Filed: May 6, 2015

(65) Prior Publication Data

US 2015/0343814 A1 Dec. 3, 2015

(30) Foreign Application Priority Data

May 29, 2014 (JP) ..... 2014-111340

(51) Int. Cl.
*B41J 29/38* (2006.01)
*B41J 25/34* (2006.01)

(52) U.S. Cl.
CPC ..... *B41J 25/34* (2013.01)

(58) Field of Classification Search
CPC ..... B41J 19/142; B41J 2/07; B41J 19/202; B41J 11/009; B41J 11/003; B41J 11/42; B65H 2220/03; B65H 2513/40; B65H 2511/516; B65H 2220/01
USPC ..... 347/5, 9–11, 16, 37, 74, 75, 101
See application file for complete search history.

(56) References Cited

U.S. PATENT DOCUMENTS 7,367,654 B2 * 5/2008 Togashi ..... B41J 2/04541 347/54

FOREIGN PATENT DOCUMENTS

| | | | |
|---|---|---|---|
| JP | 2005219288 A | * | 8/2005 |
| JP | 2011-046118 | | 3/2011 |
| JP | 2012-175869 | | 9/2012 |
| JP | 2013-014056 | | 1/2013 |

* cited by examiner

*Primary Examiner* — Hai C Pham
(74) *Attorney, Agent, or Firm* — Harness, Dickey & Pierce, P.L.C.

(57) ABSTRACT

A liquid discharging apparatus includes: a discharging portion which discharges liquid; a carriage which has the discharging portion mounted thereon, and is provided with a conductive member; a power supply source which supplies power for discharging the liquid from the discharging portion; a housing which has the power supply source installed therein; and a carriage guide axis which supports the carriage to be movable with respect to the housing, in which between the carriage guide axis and the conductive member, a coupling capacitance is formed by electric field coupling, and in which the coupling capacitance is included in a power supplying path to the discharging portion or a discharging path from the discharging portion, in a transmission path of the power.

7 Claims, 19 Drawing Sheets

LIQUID DISCHARGING APPARATUS AND CONTROL METHOD THEREOF

The entire disclosure of Japanese Patent Application No. 2014-111340, filed May 29, 2014 is expressly incorporated by reference herein.

BACKGROUND

1. Technical Field

The present invention relates to a liquid discharging apparatus and a control method thereof.

2. Related Art

In a printer, inside a housing, a carriage on which a printer head (hereinafter, referred to as a head) that discharges ink to a recording medium is mounted is provided, and the carriage moves in a main scanning direction. The head is moved by a driving control portion.

Here, a printer which is configured to have the driving control portion and the head mounted together on the carriage is known. In this type of the printer, a printing signal which controls the head is generated on a circuit substrate which is provided in the housing. Here, since it is necessary to transmit the printing signal to the carriage from the circuit substrate, the circuit substrate and the carriage are linked to each other by a flexible flat cable (hereinafter, referred to as an FFC) having high flexibility. The FFC is also used in supplying power to the driving control portion which is mounted on the carriage, from a power supply source which is installed in the housing.

As described above, since the carriage is a member which moves in the main scanning direction, when the carriage moves, the FFC is likely to be physically damaged on a mechanism. In addition, noise is likely to be generated in a control signal, such as the printing signal, through the FFC. Since these problems exist, it is desirable that a technology which configures a liquid discharging apparatus without using the FFC is employed.

In consideration of the above-described situation, in JP-A-2011-46118, a printer in which a timing belt that makes the carriage reciprocate is configured of a conductive material, such as a metal, and in which power is supplied to the driving control portion of the carriage via the timing belt and a pulley, is disclosed. In addition, in the printer suggested in JP-A-2011-46118, the control signal is supplied to the carriage by using a wireless communication technology. In JP-A-2013-14056, by using electromagnetic field coupling which uses a coil, a printer, which wirelessly transmits the power to the carriage from the housing, is disclosed.

In addition, a power transmission technology, which uses a coupling capacitance formed by electric field coupling, is also suggested. For example, in JPA-2012-175869, a vehicle power supplying apparatus, which performs AC power transmission to a vehicle body from a road surface by using an electrostatic capacitance of a tire of a vehicle, is disclosed.

In the housing of the printer, a mist of ink (hereinafter, referred to as ink mist) is present and is ionized by a high voltage, such as static electricity, that is generated as the recording medium is transported. In the printer which is disclosed in JP-A-2011-46118, since the timing belt which is configured of the conductive material is used, when the ink mist is adhered to the timing belt during energization, there is a risk of generation of heat due to a short circuit. In addition, similarly, even when the timing belt during energization falls off from the pulley which transfers power to the timing belt and comes into contact with the housing, there is a risk of generation of heat due to a short circuit. Furthermore, the ionized ink mist can be adsorbed to the timing belt. The ink mist which is adsorbed to the timing belt causes sliding between the timing belt and the pulley, and there is a possibility that a defect is generated in transferring power to the timing belt from the pulley. Furthermore, when electrostatic noise caused by a discharging phenomenon which is referred to as electrostatic discharge (ESD) is generated in the timing belt, there is a possibility that variation in power supplied to the carriage is generated and the operation of the driving control portion which serves as an electronic circuit is influenced.

In the printer disclosed in JP-A-2013-14056, there exist constraints in design or manufacturing because of installation of a resonator including the coil for electromagnetic field coupling. In other words, even during a period in which the carriage is moving, the coil which is installed in the carriage and the coil which is installed in the housing should be configured to form constant electromagnetic field coupling, and a resonance circuit including the coil which is installed in the carriage and a resonance circuit including the coil which is installed in the housing should be configured to magnetically resonate. Such constraints in configuration can increase cost in design or manufacturing the printer.

In JP-A-2012-175869, the power transmission technology which uses the coupling capacitance is disclosed, but since the technology is a power transmission technology which uses a configuration which is not provided in a printer, for example, a configuration that is specific to a vehicle, such as a tire or a road surface, the technology cannot be employed in a printer as it is.

SUMMARY

An advantage of some aspects of the invention is to provide a liquid discharging apparatus which can supply power to a driving control portion of a head mounted on a carriage, from a power supply source which is installed in a housing without using an FFC while ensuring safety.

According to an aspect of the invention, there is provided a liquid discharging apparatus, including: a discharging portion which discharges liquid; a carriage which has the discharging portion mounted thereon, and is provided with a conductive member; a power supply source which supplies power for discharging the liquid from the discharging portion; a housing which has the power supply source installed therein; and a carriage guide axis which supports the carriage to be movable with respect to the housing. Between the carriage guide axis and the conductive member, a coupling capacitance is formed by electric field coupling. The coupling capacitance is included in a power supplying path to the discharging portion or a discharging path from the discharging portion, in a transmission path of the power.

In this case, since the power is wirelessly transmitted to a head unit which is mounted on the carriage by the coupling capacitance, compared to a case where the power is supplied by physical wiring, it is possible to reduce a possibility of generation of noise. Accordingly, it is possible to prevent deterioration of a printing quality due to the noise. In addition, in this case, power transmission is performed by using the coupling capacitance which is formed between the carriage guide axis and the conductive member, an electric field induction type has higher transmission efficiency compared to an electromagnetic induction type, and thus, the electric field induction type is appropriate in transmitting a high voltage which is necessary in discharging the liquid.

Furthermore, since the conductive member is provided in the carriage, the carriage guide axis and the conductive member are not short-circuited. Here, when the conductive member is used as a bearing of the carrier guide axis, the conductive member is disposed so that the carriage does not rattle and a substantially constant distance from the carriage guide axis is retained. In addition, an area in which the carriage guide axis and the conductive member face each other is determined by an area of the conductive member. Therefore, when a value of the coupling capacitance which is formed by electric field coupling between the carriage guide axis and the conductive member can be substantially constant, it is possible to stably transmit the power.

In the liquid discharging apparatus according to the aspect of the invention, between the carriage guide axis and the conductive member, at least liquid or solid which has higher permittivity compared to air may be provided.

In this case, since the liquid or the solid which has higher permittivity compared to the air is provided between the carriage guide axis and the conductive member, the coupling capacitance becomes greater and transmission efficiency becomes higher compared to a configuration in which the air is interposed between the carriage guide axis and the conductive member.

Furthermore, in a case where the liquid or the solid which has higher permittivity than that of the air has insulating properties, and in a case where the liquid or the solid is provided to cover an outer circumferential surface of the carriage guide axis, even under the circumstance that there is a large amount of ink mist, a problem due to adhesion of the ink mist is not generated, or rather, frictional resistance between the carriage guide axis and the carriage decreases, and a load of a carriage motor for driving the carriage decreases.

In the liquid discharging apparatus according to the aspect of the invention, the carriage guide axis may have a substantially cylindrical shape, and the conductive member may include a surface which has a circular arc shape along an outer circumferential surface of the carriage guide axis when viewed from an axial direction of the carriage guide axis.

In this case, since the conductive member is configured, for example, as a bearing of the carriage guide axis, by the conductive member and the carriage guide axis, a capacitor which is referred to as a concentric cylindrical capacitor is formed. Compared to a capacitor which is referred to as a parallel plate capacitor, in the concentric cylindrical capacitor, an area of an electrode which forms the electric field coupling is configured to be large, and a large capacitance is likely to be obtained. Therefore, in this case, it is easy to make the coupling capacitance large in volume.

In the liquid discharging apparatus according to the aspect of the invention, the conductive member may have a substantially planar shape, and the carriage guide axis may include a plane which faces the conductive member.

In this case, the coupling capacitance is formed by the electric field coupling between the conductive member having a substantially planar shape, and the plane which is provided on the carriage guide axis to face the conductive member.

In the liquid discharging apparatus according to the aspect of the invention, as the carriage guide axis, a first carriage guide axis which forms the coupling capacitance included in the power supplying path, and a second carriage guide axis which forms the coupling capacitance included in the discharging path, may be provided. As the conductive member, a first conductive member which forms the coupling capacitance by electric field coupling between the first carriage guide axis and the first conductive member, and a second conductive member which forms the coupling capacitance by electric field coupling between the second carriage guide axis and the second conductive member, may be provided.

In this case, the liquid discharging apparatus includes at least two groups of the carriage guide axis and the conductive member. Therefore, since two coupling capacitances are formed, it is possible to use the coupling capacitances respectively in the power supplying path and the discharging path.

In the liquid discharging apparatus according to the aspect of the invention, the carriage may include a head which has the discharging portion, and a head information managing portion which manages head information according to the head. The housing may include a control portion which generates a control signal that controls discharging of the liquid, and a control signal transmitting portion which wirelessly transmits the control signal to the head. The head information may be transmitted to the control portion from the head information managing portion, via the coupling capacitance.

In this case, since it is possible to transmit the head information by using the transmission path of power, without newly providing a transmitting unit of the head information, it is possible to control the liquid discharging apparatus based on the head information.

According to another aspect of the invention, there is provided a control method of a liquid discharging apparatus, which includes a discharging portion which discharges liquid, a carriage which has the discharging portion mounted thereon, and is provided with a conductive member, a power supply source which supplies power for discharging the liquid from the discharging portion, a housing which has the power supply source installed therein, and a carriage guide axis which supports the carriage to be movable with respect to the housing, including: forming a coupling capacitance by electric field coupling between the carriage guide axis and the conductive member; transmitting the power to the discharging portion via the coupling capacitance; and discharging the liquid from the discharging portion by the transmitted power.

In this case, since the power is wirelessly transmitted by the coupling capacitance to the head unit which is mounted on the carriage, compared to a case where the power is supplied by the physical wiring, it is possible to reduce a possibility of generation of noise. Accordingly, it is possible to prevent deterioration of a printing quality due to the noise. In addition, in this case, power transmission is performed by using the coupling capacitance which is formed between the carriage guide axis and the conductive member, the electric field induction type has higher transmission efficiency compared to the electromagnetic induction type, and thus, the electric field induction type is appropriate in transmitting a high voltage which is necessary in discharging the liquid.

Furthermore, since the conductive member is provided in the carriage, the carriage guide axis and the conductive member are not short-circuited. Here, in the liquid discharging apparatus, when the conductive member is used as the carrier guide axis and a bearing thereof, the conductive member is disposed so that the carriage does not rattle and a substantially constant distance from the carriage guide axis is retained. In addition, an area in which the carriage guide axis and the conductive member face each other is determined by an area of the conductive member. Therefore, a constant distance between the carriage guide axis and the conductive member is always held. Therefore, if the conductive member is provided as the bearing, it is possible to keep a value of the coupling capacitance which is formed by the electric field coupling between the carriage guide axis and the conductive member substantially constant, and to stably transmit the power. Since the constant value is maintained, it is not necessary to additionally provide a mechanism which performs adjustment of the coupling capacitance.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for realizing the invention will be described with reference to the drawings. However, in each drawing, dimensions and scales of each portion are appropriately different from real dimensions and scales. In addition, since the embodiments which will be described below are appropriate specific examples of the invention, various restrictions which are technically preferable are applied. However, if there is no particular limitation of the invention in the description below, the range of the invention is not limited to these embodiments.

1. Configuration of Ink Jet Printer

Figure 1:
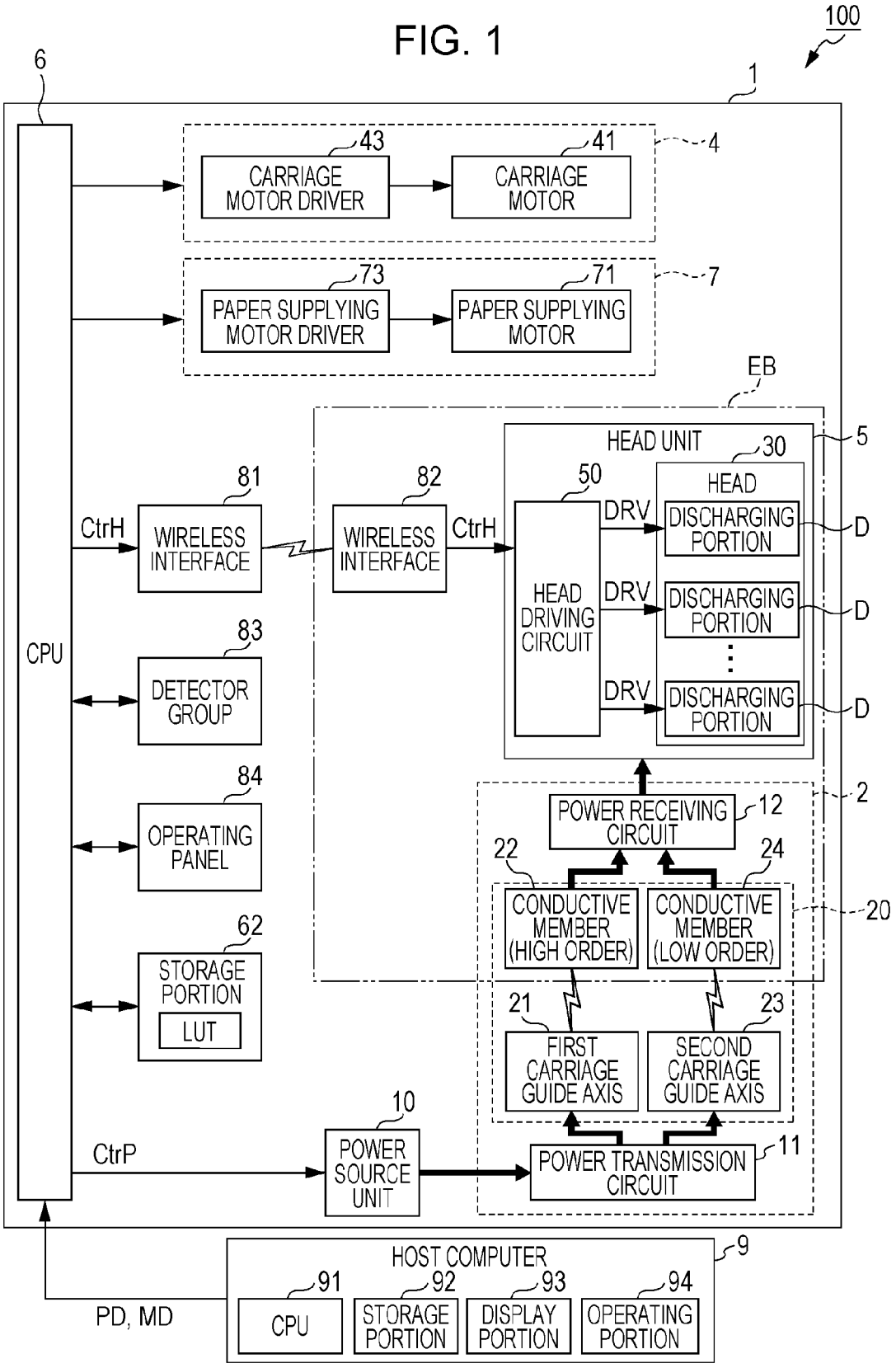
FIG. 1 is a block diagram illustrating a configuration of an ink jet printer according to an embodiment of the invention.

FIG. 1 is a functional block diagram illustrating a configuration of a printing system 100. As described in FIG. 1, the printing system 100 includes an ink jet printer 1 and a host computer 9.

The host computer 9 is, for example, a personal computer or a digital camera.

As illustrated in FIG. 1, the host computer 9 includes a central processing unit (CPU) 91 which controls operations of the host computer 9, a storage portion 92 which includes a random access memory (RAM) or a hard disk drive, a display portion 93, such as a display, and an operating portion 94, such as a keyboard or a mouse.

In the storage portion 92, a printer driver program which corresponds to the ink jet printer 1 is stored. The CPU 91 performs halftone processing or rasterizing processing, with respect to image data that a user of the ink jet printer 1 desires to print, by executing the printer driver program. Accordingly, the CPU 91 converges the image data, and generates printing data PD which corresponds to printing processing by the ink jet printer 1.

Figure 2:
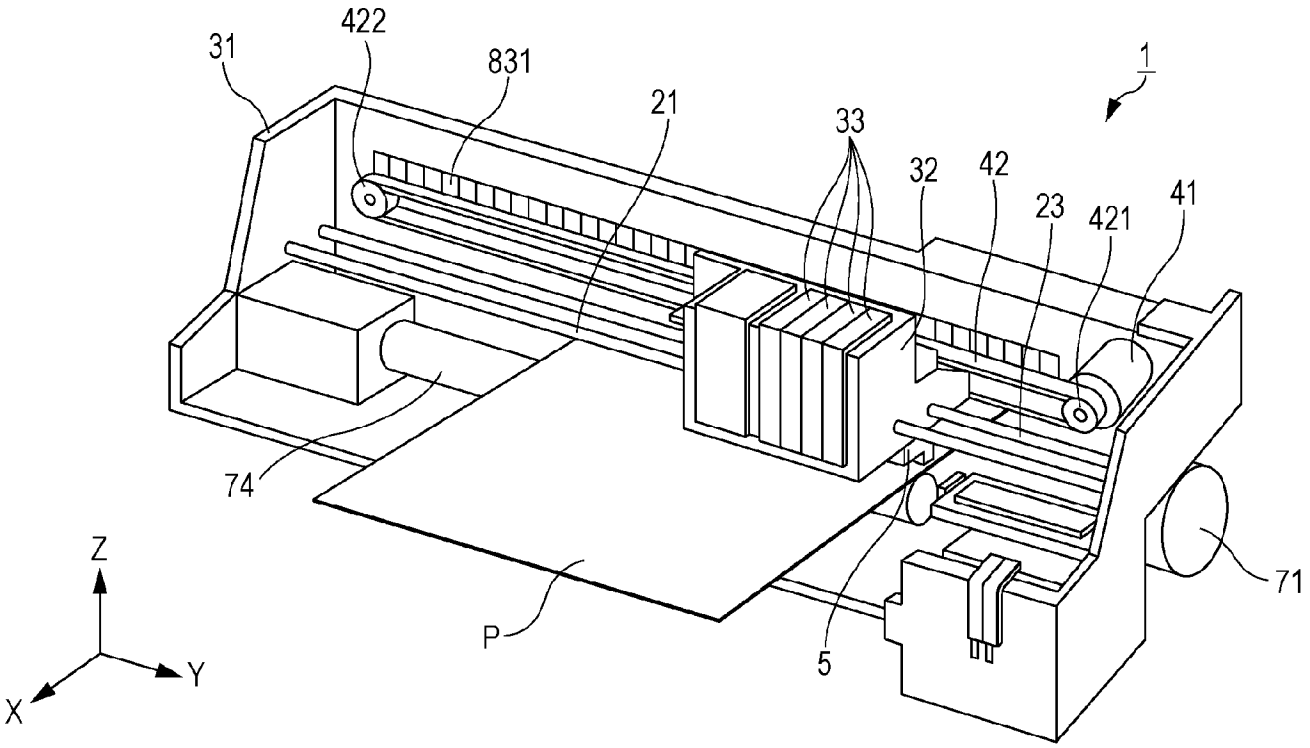
FIG. 2 is a perspective view illustrating an overview of the configuration of the ink jet printer.
Figure 3:
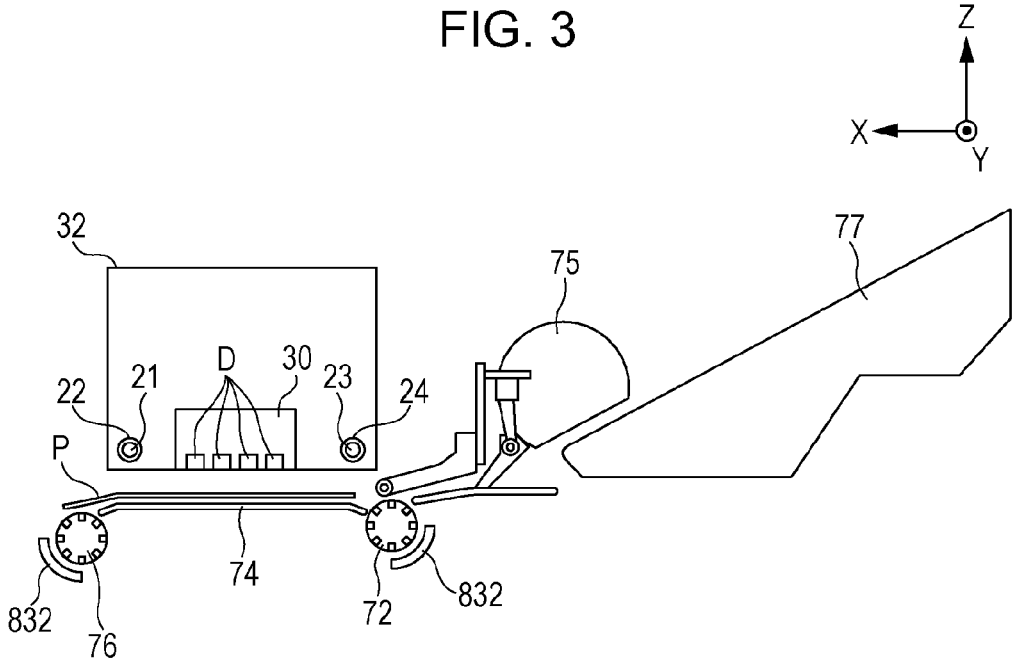
FIG. 3 is a schematic partial cross-sectional view of the ink jet printer.

FIG. 2 is a schematic perspective view illustrating a configuration of the inside of the ink jet printer 1. FIG. 3 is a schematic cross-sectional view illustrating a cross-sectional structure of the ink jet printer 1. In addition to FIG. 1, with reference to FIGS. 2 to 3, a configuration of the ink jet printer 1 will be described.

The ink jet printer 1 according to the embodiment is an example of a "liquid discharging apparatus" which discharges ink (an example of "liquid") and generates an image on a recording medium P.

As illustrated in FIG. 2, the ink jet printer 1 includes a housing 31 which accommodates each constituent element of the ink jet printer 1, and a carriage 32 which reciprocates in an +Y direction and in a −Y direction (an example of a "main scanning direction") with respect to the housing 31.

As illustrated in FIG. 2, a head unit 5 and four ink cartridges 33 are mounted on the carriage 32.

The four ink cartridges 33 which are mounted on the carriage 32 are provided to correspond to four colors, such as yellow (Yl), cyan (Cy), magenta (Mg), and black (Bk), one for one. Each ink cartridge 33 is filled with the ink having a color that corresponds to the ink cartridge 33.

As illustrated in FIG. 1, a head unit 5 includes a head 30 which is provided with M discharging portions D, and a head driving circuit 50 which generates a driving signal DRV for driving each discharging portion D (M is a natural number which is equal to or greater than 4). M discharging portions D are divided into four groups to correspond to four ink cartridges 33 one for one. Each discharging portion D receives the ink supplied from the corresponding ink cartridge 33, among four ink cartridges 33. The inside of the discharging portion D is filled with the ink supplied from the corresponding ink cartridge 33, and the discharging portion D can discharge the ink which fills the inside from nozzles N (discharging ports) provided in the discharging portion D, based on the driving signal DRV. For this reason, it is possible to discharge four colors of ink in total from M discharging portions D, and to perform printing in full color by the ink jet printer 1. The head unit 5 will be described in detail later.

In addition, hereinafter, there is a case where a constituent element which is mounted on the carriage 32 among the constituent elements of the ink jet printer 1, is referred to as a "mounted object EB".

In addition, as illustrated in FIG. 1, the ink jet printer 1 includes a moving mechanism 4 for making the carriage 32 reciprocate in a Y-axis direction (carriage moving direction).

As illustrated in FIGS. 1 and 2, the moving mechanism 4 includes a carriage motor 41 which is a driving source that makes the carriage 32 reciprocate, a first carriage guide axis 21 and a second carriage guide axis 23 which are two conductive carriage guide axes in which both ends are fixed to the housing 31, and are parallel to each other, a timing belt 42 which extends in parallel with respect to the first carriage guide axis 21 and the second carriage guide axis 23 and is driven by the carriage motor 41, and a carriage motor driver 43 for driving the carriage motor 41.

The carriage 32 is supported to freely reciprocate by the first carriage guide axis 21 and the second carriage guide axis 23. In addition, a fixing tool 321 (refer to FIG. 9) which is fixed to the carriage 32 is fixed to a connecting portion of the timing belt 42.

As illustrated in FIG. 2, the timing belt 42 is placed on (placed over) a pulley 421 and a pulley 422. When the carriage motor 41 rotates and drives the pulley 421, the timing belt 42 reversely travels in conjunction with rotation of the pulley 421. Specifically, when the pulley 421 is rotated and driven, a part which is on an upper side (+Z direction) of the pulley 421 and the pulley 422 in the timing belt 42 moves in one of the +Y direction and the −Y direction, and a part which is on a lower side (−Z direction) of the pulley 421 and the pulley 422 in the timing belt 42 moves in the other direction of the +Y direction and the −Y direction. For this reason, as the carriage motor 41 rotates and drives the pulley 421, the connecting portion (a part which is fixed to the fixing tool 321 of the carriage 32 in the timing belt 42) of the timing belt 42 moves in the +Y direction or in the −Y direction, and according to this, the carriage 32 is guided to the first carriage guide axis 21 and the second carriage guide axis 23, and reciprocates in the Y-axis direction.

As illustrated in FIG. 1, the ink jet printer 1 is provided with a paper supplying mechanism 7 for supplying and discharging the recording medium P.

As illustrated in FIGS. 1 to 3, the paper supplying mechanism 7 includes a paper supplying motor 71 which is a driving source of the paper supplying mechanism 7, a paper supplying motor driver 73 for driving the paper supplying motor 71, a tray 77 which installs the recording medium P, a platen 74 which is provided on a lower side (−Z direction) of the carriage 32, paper supplying rollers 72 and 75 which rotate by an operation of the paper supplying motor 71 and supplies the recording medium P onto the platen 74 one by one, and a paper discharging roller 76 which rotates by the operation of the paper supplying motor 71, and transports the recording medium P on the platen 74 to a paper discharging port (not illustrated). The paper supplying mechanism 7 can transport the recording medium P toward a +X direction (transporting direction) in the same drawing. Hereinafter, a path through which the recording medium P is transported by the paper supplying mechanism 7 is referred to as a "transporting path".

The ink jet printer 1 performs the printing processing which forms the image on the recording medium P by discharging the ink from the plurality of discharging portions D with respect to the recording medium P which is transported onto the transporting path (to be accurate, onto the platen 74).

As illustrated in FIG. 1, the ink jet printer 1 includes a CPU 6 which controls operations of each portion of the ink jet printer 1, a storage portion 62 which stores various pieces of information, a power source unit 10 (an example of a "power supplying source") which supplies power to each portion of the ink jet printer 1, a power transmission portion 2 (an example of a "power transmission portion") for transmitting the power supplied from the power source unit 10 to the head unit 5, a detector group 83 which detects positions of the carriage 32 and the recording medium P, and an operating panel 84 which is made of the display portion that displays an error message or the like and the operating portion configured of various switches.

The storage portion 62 includes an electrically erasable programmable read-only memory (EEPROM) which is a type of nonvolatile semiconductor memory that temporarily accommodates the printing data PD supplied from the host computer 9 via an interface portion (not illustrated) in a data accommodation region, a random access memory (RAM) which temporarily accommodates data that is necessary when performing various types of processing, such as the printing processing, or temporarily develops a control program for performing various types of processing, such as the printing processing, and a PROM which accommodates the control program for controlling each portion of the ink jet printer 1 or a recording medium information table TBL which will be described later, and which is one type of nonvolatile semiconductor memory.

The CPU 6 stores the printing data PD which is supplied from the host computer 9 via the interface portion (not illustrated) in the storage portion 62. Then, the CPU performs the printing processing which forms the image according to the printing data PD on the recording medium P by controlling operations of the head unit 5, the power source unit 10, the moving mechanism 4, and the paper supplying mechanism 7, based on the printing data PD.

Specifically, based on the printing data PD, the CPU 6 controls the operation of the head driving circuit 50 and generates a control signal CtrH for driving each discharging portion D, and supplies the control signal CtrH to the head unit 5, via wireless communication between a wireless interface 81 provided in the housing 31 and a wireless interface 82 mounted on the carriage 32 as the mounted object EB. Accordingly, the CPU 6 controls the presence or the absence of the ink discharged from each discharging portion D, and a discharging amount and a discharging timing of the ink when the ink is discharged, via the control of the operation of the head driving circuit 50.

In addition, based on various types of data accommodated in the storage portion 62 and a detected value from the detector group 83, the CPU 6 generates a control signal for controlling the operation of the carriage motor driver 43, and a control signal for controlling the operation of the paper supplying motor driver 73, and outputs these various generated control signals. Accordingly, the CPU 6 drives the carriage motor 41 to intermittently feed the recording medium P in an auxiliary scanning direction (+X direction) one by one via the control of the operation of the carriage motor driver 43, and in addition, the CPU 6 drives the paper supplying motor 71 to make the carriage 32 reciprocate in the main scanning direction (+Y direction and −Y direction) via the control of the operation of the paper supplying motor driver 73.

In this manner, by controlling the operations of each portion of the ink jet printer 1, the CPU 6 adjusts a size and disposition of dots which are formed by the ink discharged onto the recording medium P, and performs the printing processing which forms the image that corresponds to the printing data PD on the recording medium P.

The detector group 83 includes a linear encoder 831 (refer to FIG. 2) and a rotary encoder 832 (refer to FIG. 3).

The linear encoder 831 includes a scale on which printing is performed in a stripe shape with a predetermined interval in the main scanning direction, and a pair of a light-emitting element and a light-receiving element which are disposed at positions that face the scale of the carriage 32 (in FIG. 2, only the scale is illustrated). The linear encoder 831 detects a moving amount in the main scanning direction of the carriage 32, and outputs a detection result.

The rotary encoder 832 includes a scale on which printing is performed in a stripe shape with a predetermined angle in a rotating direction of the paper supplying roller and the paper discharging roller, and a pair of a light-emitting element and a light-receiving element which are disposed at positions that face the scale. The rotary encoder 832 detects a rotating amount of the paper supplying roller and the paper discharging roller, and outputs a detection result. Based on the detection result from the linear encoder 831, the CPU 6 can calculate the position of the carriage 32 in the Y-axis direction. In addition, based on the detection result from the rotary encoder 832, the CPU 6 can calculate the position of the recording medium P in an X-axis direction on the transporting path.

The power source unit 10 is provided in the housing 31, and supplies the power with respect to the mounted object EB, such as the head unit 5, via the power transmission portion 2.

The power is calculated by a product of a voltage and a current, and in order to transmit the power to the load, it is necessary to provide the power supplying path which makes the current flow toward the load from the power source which generates the power, and a discharging path through which the current that returns to the power source from the load flows. In other words, in general, the power source is electrically connected to the load via the power supplying path and the discharging path, and applies power supply voltage to the power supplying path and the discharging path.

The power source unit 10 according to the embodiment is connected to an AC power socket for home use via a power code, and generates an AC voltage. As the power source unit 10 supplies a first power source signal to the power supplying path, and supplies a second power source signal to the discharging path, the power supply voltage which is given as a potential difference between the first power source signal and the second power source signal is applied to the power supplying path and the discharging path.

In addition, in the embodiment, an expression "supply the power" means supplying the power source signal to at least one of the power supplying path and the discharging path, and includes a meaning of applying the power supply voltage to the power supplying path and the discharging path.

In addition, although this will be described in detail later, a potential of the first power source signal and a potential of the second power source signal which are output by the power source unit 10, or a size of the power supply voltage, are determined based on the power source control signal CtrP which is supplied from the CPU 6.

In addition, the ink jet printer 1 includes a DC power source (not illustrated) which is connected to the AC power socket for home use or the like, in addition to the power source unit 10. The power is supplied from the DC power source to each portion fixed to the housing 31.

Figure 4:
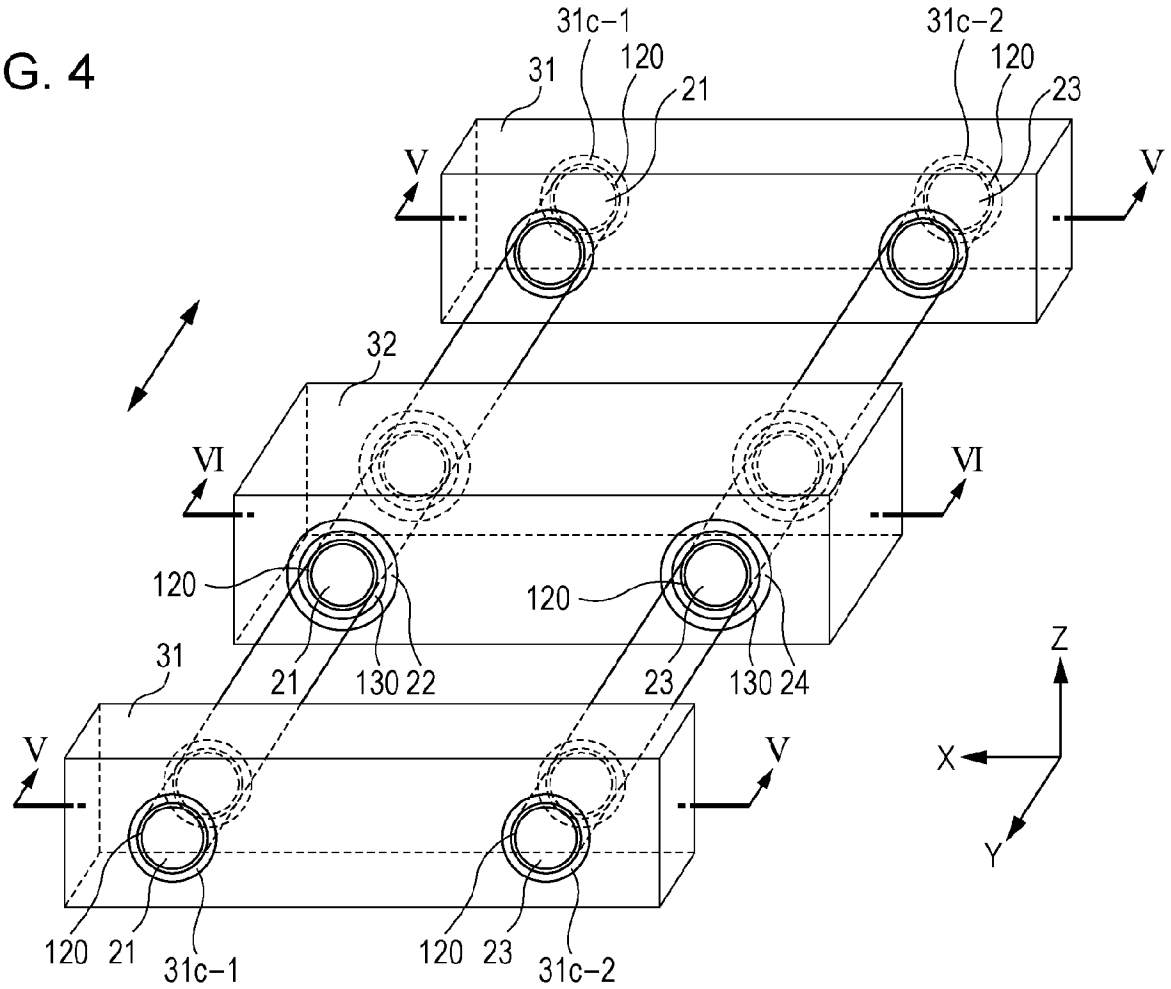
FIG. 4 is a schematic view illustrating a configuration of a wireless transmission portion.
Figure 5:
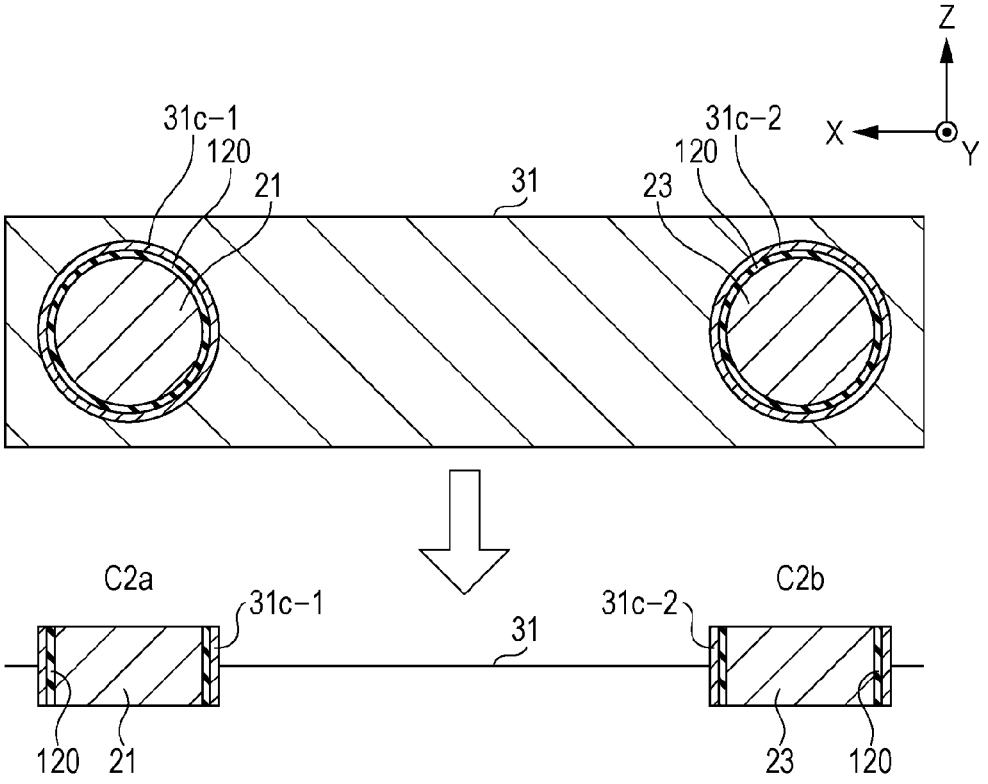
FIG. 5 is an arrow cross-sectional view along line V-V in FIG. 4.

As illustrated in FIG. 1, the power transmission portion 2 includes a power transmission circuit 11 which is provided in the housing 31, a power receiving circuit 12 which is mounted on the carriage 32 as the mounted object EB, and a wireless transmission portion 20. FIG. 4 is a schematic view illustrating a configuration of the wireless transmission portion 20. FIG. 5 is an arrow cross-sectional view along V-V in FIG. 4.

As illustrated in FIG. 5, an insulator 120 is provided on an outer circumference of the first carriage guide axis 21. The insulator 120 has, for example, a shape of a film, and is made of a material having higher permittivity than air. In addition, a fixing portion 31*c*-1 which has the first carriage guide axis 21 that is inserted and fixed to the housing 31 has conductivity. Similarly, the insulator 120 is provided on an outer circumference of the second carriage guide axis 23. In addition, a fixing portion 31*c*-2 which has the second carriage guide axis 23 that is inserted and fixed to the housing 31 has conductivity.

In other words, in the housing 31, the first carriage guide axis 21 and the fixing portion 31*c*-1 which have conductivity face each other in a state where the insulator 120 is nipped therebetween, and a coupling capacitance C2*a* is formed by electric field coupling between the first carriage guide axis 21 and the fixing portion 31*c*-1. The coupling capacitance can be used as at least a part of a capacitance C2 in the power transmission circuit 11 illustrated in FIG. 10. In addition, a capacitance value C2*a* of the coupling capacitance, which is formed by the electric field coupling between the first carriage guide axis 21 and the fixing portion 31*c*-1, can appropriately set a distance therebetween by adjusting the thickness of the insulator 120.

Similarly, in the housing 31, the second carriage guide axis 23 and the fixing portion 31*c*-2 which have conductivity face each other in a state where the insulator 120 is nipped therebetween, and a coupling capacitance C2*b* is formed by the electric field coupling between the second carriage guide axis 23 and the fixing portion 31*c*-2. The coupling capacitance can be used as at least a part of the capacitance C2 in the power transmission circuit 11 illustrated in FIG. 10.

In addition, a capacitance value C2*b* of the coupling capacitance, which is formed by electric field coupling between the second carriage guide axis 23 and the fixing portion 31*c*-2, can appropriately set the distance therebetween by adjusting the thickness of the insulator 120.

Figure 10:
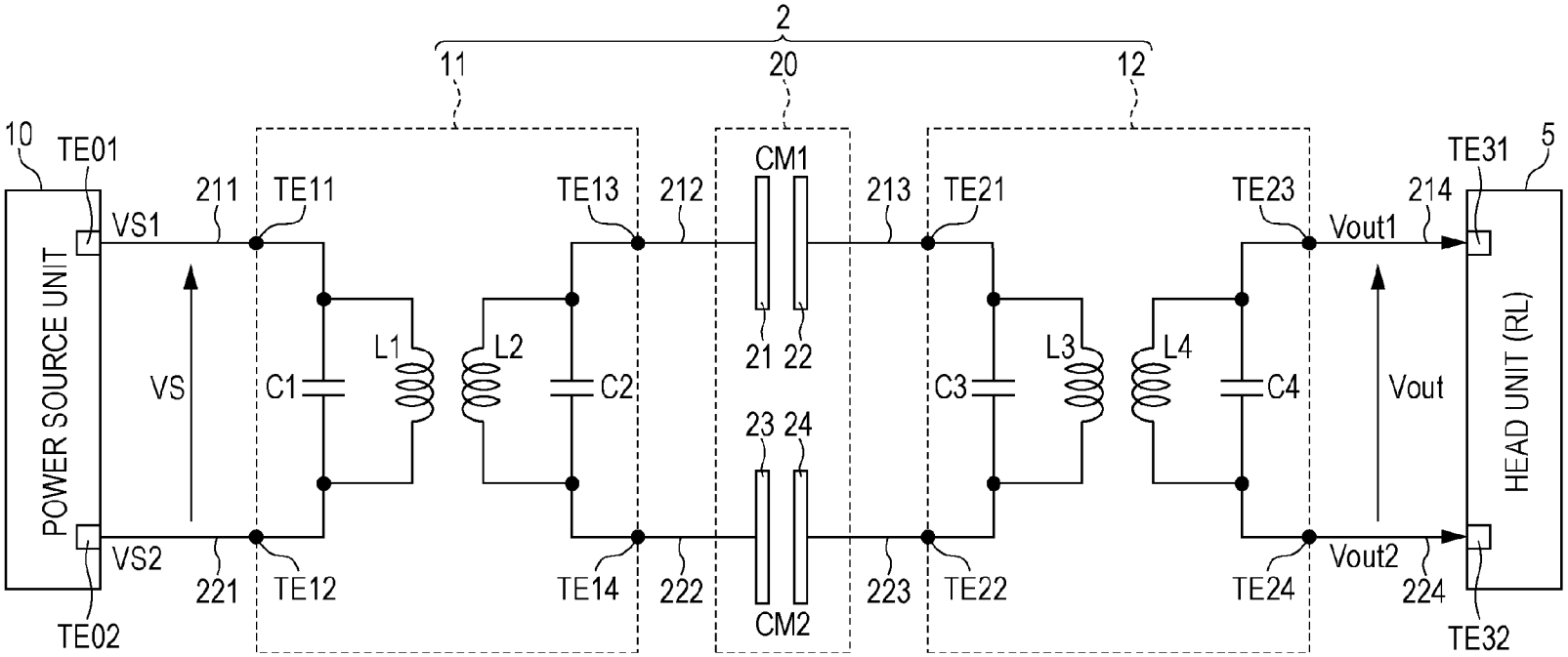
FIG. 10 is a circuit diagram of the power transmission portion.

Here, the fixing portion 31*c*-1 and the fixing portion 31*c*-2 are short-circuited by the housing 31. In other words, a part at least between the fixing portion 31*c*-1 and the fixing portion 31*c*-2 in the housing 31 is made of a material having conductivity. Therefore, as illustrated in FIG. 5, the coupling capacitance C2*a* which is formed by the first carriage guide axis 21 and the fixing portion 31*c*-1 and the coupling capacitance C2*b* which is formed by the second carriage guide axis 23 and the fixing portion 31*c*-2, are expressed as two capacitances which are connected in series. The capacitance C2 in the power transmission circuit 11 illustrated in FIG. 10 illustrates a synthetic capacitance of the coupling capacitance C2*a* and the coupling capacitance C2*b* that are connected in series.

Figure 6:
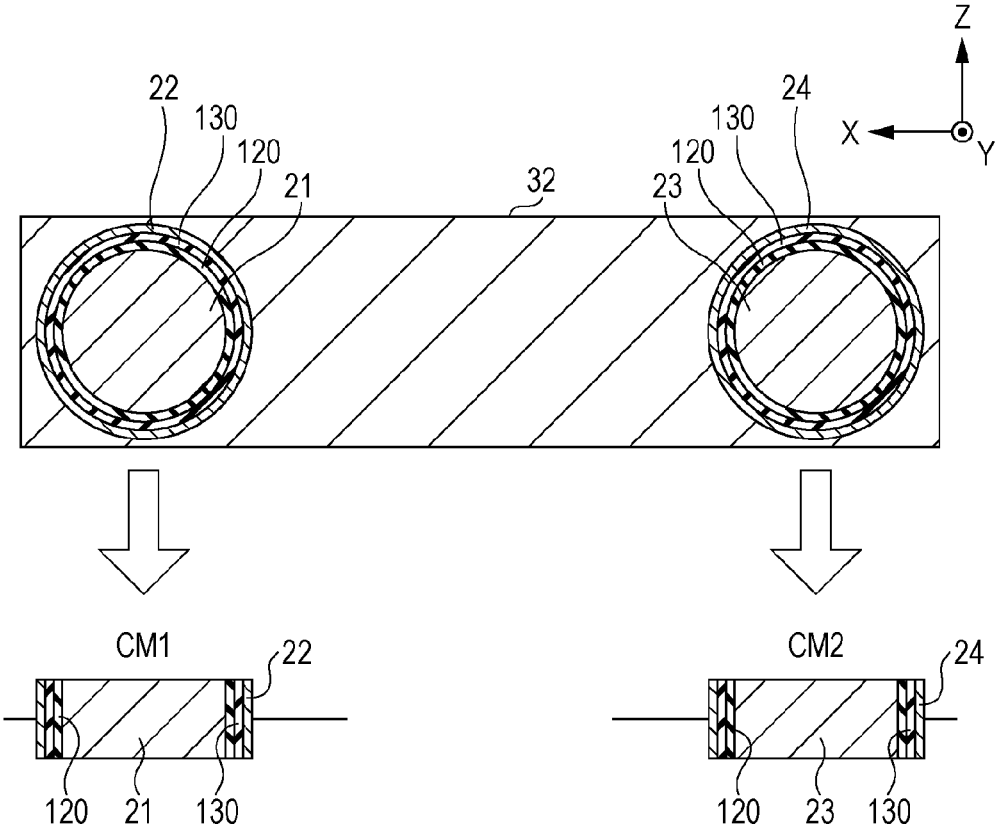
FIG. 6 is an arrow cross-sectional view along line VI-VI in FIG. 4.

FIG. 6 is an arrow cross-sectional view along VI-VI in FIG. 4. The first carriage guide axis 21 is inserted through a conductive member (high order) 22 which is a bearing of the first carriage guide axis 21 in the carriage 32. Here, on the insulator 120 which is provided on an outer circumferential surface of the first carriage guide axis 21, as described in FIG. 6, a lubricating layer (for example, a layer which is made of an insulating material, such as an oil film) 130 which reduces a frictional resistance between the lubricating layer 130 and the conductive member (high order) 22 is further formed. The lubricating layer 130 is made of a material having higher permittivity than air.

In other words, in the carriage 32, the first carriage guide axis 21 having conductivity and the conductive member (high order) 22 face each other in a state where the insulator 120 and the lubricating layer 130 are nipped therebetween, and a coupling capacitance CM1 is formed by the electric field coupling between the first carriage guide axis 21 and the conductive member (high order) 22. As illustrated in FIG. 6, the coupling capacitance CM1 considers the first carriage guide axis 21 as one electrode and considers the conductive member (high order) 22 as the other electrode. The coupling capacitance CM1 is expressed as a capacitance which is provided with the insulator 120 and the lubricating layer 130 as dielectric substances between the electrodes.

Similarly, the second carriage guide axis 23 is inserted through a conductive member (low order) 24 which is a bearing of the second carriage guide axis 23 in the carriage 32. Here, on the insulator 120 which is provided on an outer circumferential surface of the second carriage guide axis 23, as described in FIG. 6, the lubricating layer (for example, a layer which is made of an insulating material, such as an oil film) 130 which reduces a frictional resistance between the lubricating layer 130 and the conductive member (high order) 24 is further formed. The lubricating layer 130 is made of a material having higher permittivity than air.

In other words, in the carriage 32, the second carriage guide axis 23 having conductivity and the conductive member (low order) 24 face each other in a state where the insulator 120 and the lubricating layer 130 are nipped therebetween, and a coupling capacitance CM2 is formed by the electric field coupling between the second carriage guide axis 23 and the conductive member 24. As illustrated in FIG. 6, the coupling capacitance CM2 considers the second carriage guide axis 23 as one electrode and considers the conductive member (low order) 24 as the other electrode. The coupling capacitance CM2 is expressed as a capacitance which is provided with the insulator 120 and the lubricating layer 130 as dielectric substances between the electrodes.

In the above-described configuration, at least a part of the first carriage guide axis 21 provided in the housing 31 always faces the conductive member (high order) which is the bearing provided in the carriage 32. Similarly, at least a part of the second carriage guide axis 23 always faces the conductive member (low order) 24 which is the bearing provided in the carriage 32. In addition, the power transmission portion 2 will be described in detail later with reference to FIG. 10.

2. Regarding Head

Next, with reference to FIGS. 7 and 8, the head 30 and the discharging portion D which is provided in the head 30, will be described.

Figure 7:
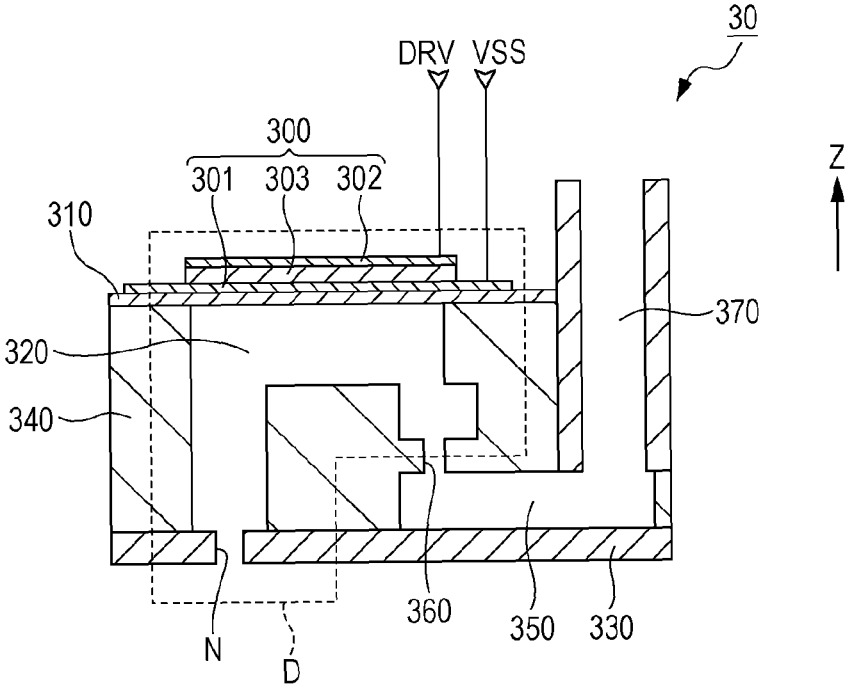
FIG. 7 is a schematic partial cross-sectional view of a head.

FIG. 7 is an example of a schematic partial cross-sectional view of the head 30. In addition, in FIG. 7, for convenience of drawing, in the head 30, one discharging portion D of M discharging portions D, a reservoir 350 which communicates with the discharging portion D via an ink supply port 360, and an ink inlet 370 for supplying the ink to the reservoir 350 from the ink cartridge 33, are illustrated.

As illustrated in FIG. 7, the discharging portion D includes a piezoelectric element 300, a cavity 320 (pressure chamber) which is filled with the ink therein, the nozzles N which communicate with the cavity 320, and a diaphragm 310. As the piezoelectric element 300 is driven by the driving signal DRV, the discharging portion D discharges the ink in the cavity 320 from the nozzles N.

The cavity 320 of the discharging portion D is a space which is partitioned by a cavity plate 340 which is formed in a predetermined shape to have a concave portion, a discharging surface 330 on which the nozzles N are formed, and the diaphragm 310. The cavity 320 communicates with the reservoir 350 via the ink supply port 360. The reservoir 350 communicates with the ink cartridge 33 via the ink inlet 370.

In the embodiment, as the piezoelectric element 300, a unimorph (monomorph) type as illustrated in FIG. 7 is employed. The piezoelectric element 300 includes a lower electrode 301, an upper electrode 302, and a piezoelectric substance 303 which is provided between the lower electrode 301 and the upper electrode 302. As a reference potential VSS which will be described later is supplied to the lower electrode 301, and the driving signal DRV is supplied to the upper electrode 302, if the voltage is applied between the lower electrode 301 and the upper electrode 302, the piezoelectric element 300 bends in a vertical direction in the drawing in accordance with the applied voltage, and consequently, the piezoelectric element 300 vibrates.

In an upper surface opening portion of the cavity plate 340, the diaphragm 310 is provided, and the lower electrode 301 is bonded to the diaphragm 310. For this reason, if the piezoelectric element 300 vibrates by the driving signal DRV, the diaphragm 310 also vibrates. A volume (pressure in the cavity 320) of the cavity 320 changes by the vibration of the diaphragm 310, and the ink which fills the inside of the cavity 320 is discharged from the nozzles N.

When the amount of ink in the cavity 320 is reduced as the ink is discharged, the ink is supplied from the reservoir 350. In addition, the ink is supplied to the reservoir 350 via the ink inlet 370, from the ink cartridge 33.

Figure 8:
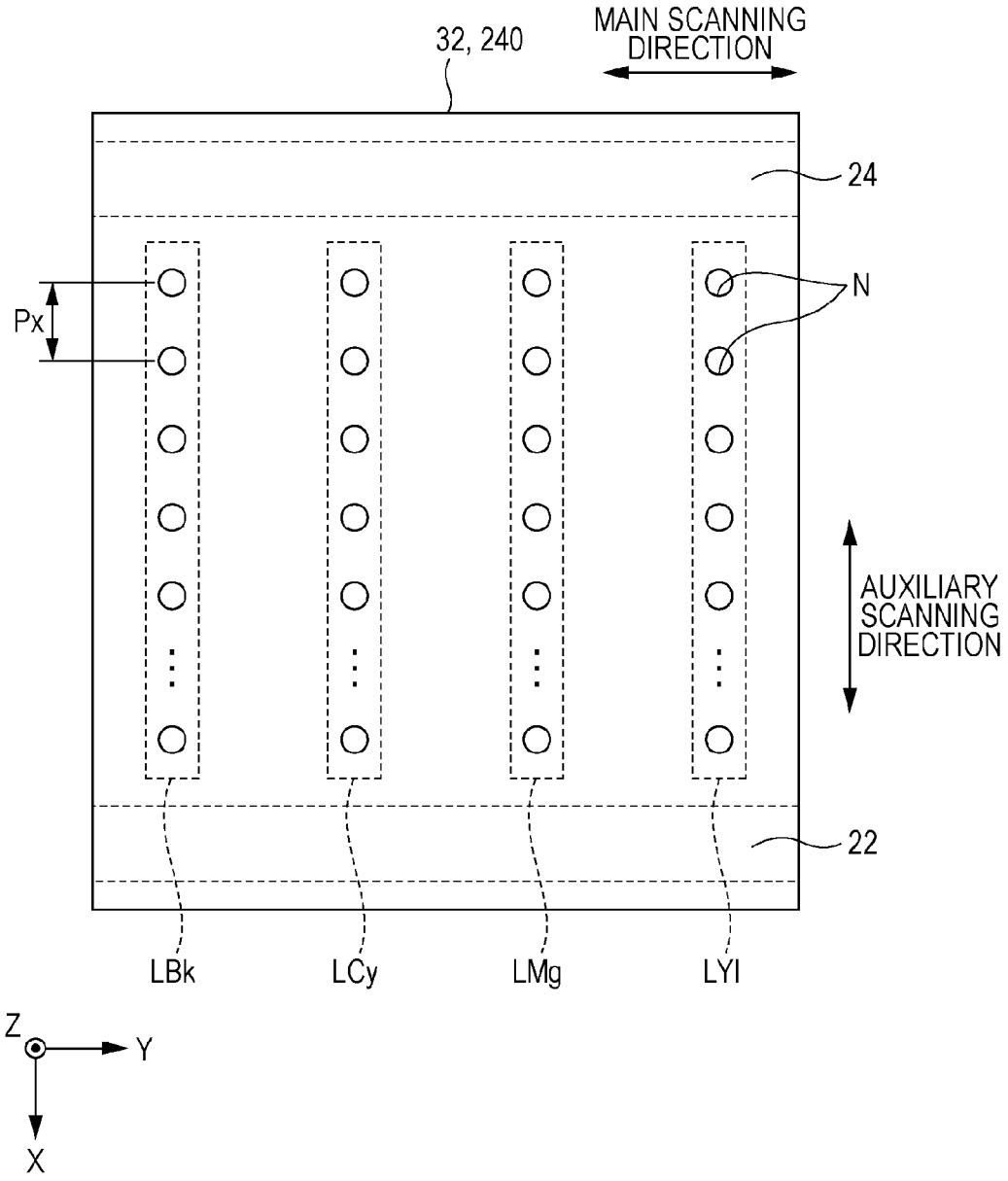
FIG. 8 is a plan view illustrating disposition of nozzles in the head.

FIG. 8 is a view describing disposition of M nozzles N provided with the head 30, and disposition of the conductive member (high order) 22 and the conductive member (low order) 24 when the carriage 32 is viewed from the +Z direction.

M nozzles N are disposed in a state where four nozzle rows are aligned, in the head 30 provided in the carriage 32. More specifically, as illustrated in FIG. 8, in the head 30, a nozzle row LBK which is made of a plurality of nozzles N that respectively correspond to the plurality of discharging portions D that discharge black ink, a nozzle row LCy which is made of a plurality of nozzles N that respectively correspond to the plurality of discharging portions D that discharge cyan ink, a nozzle row LMg which is made of a plurality of nozzles N that respectively correspond to the plurality of discharging portions D that discharge magenta ink, and a nozzle row LY1 which is made of a plurality of nozzles N that respectively correspond to the plurality of discharging portions D that discharge yellow ink, are provided. In addition, in each nozzle row, a pitch Px between the nozzles N can be appropriately set in accordance to a dot per inch (dpi).

In addition, in the carriage 32, in an end portion on the +X direction side, the conductive member (high order) 22 which is the bearing of the first carriage guide axis 21 is provided to extend in the Y-axis direction. In addition, in an end portion on a −X direction side, the conductive member (low order) 24 which is the bearing of the second carriage guide axis 23 is provided to extend in the Y-axis direction.

In addition, in the embodiment, as illustrated in FIG. 8, each nozzle row is a row in which the plurality of nozzles N are aligned in one row in the X-axis direction. However, the invention is not limited to such nozzle rows, and for example, a nozzle row, in which positions of even-numbered nozzles N and odd-numbered nozzles N among the plurality of nozzles N that constitute each nozzle row are different in the Y-axis direction, and which is arrange in a so-called zigzag shape, may be provided.

3. Regarding Power Transmission Portion

Next, the power transmission portion 2 will be described with reference to FIG. 9.

Figure 9:
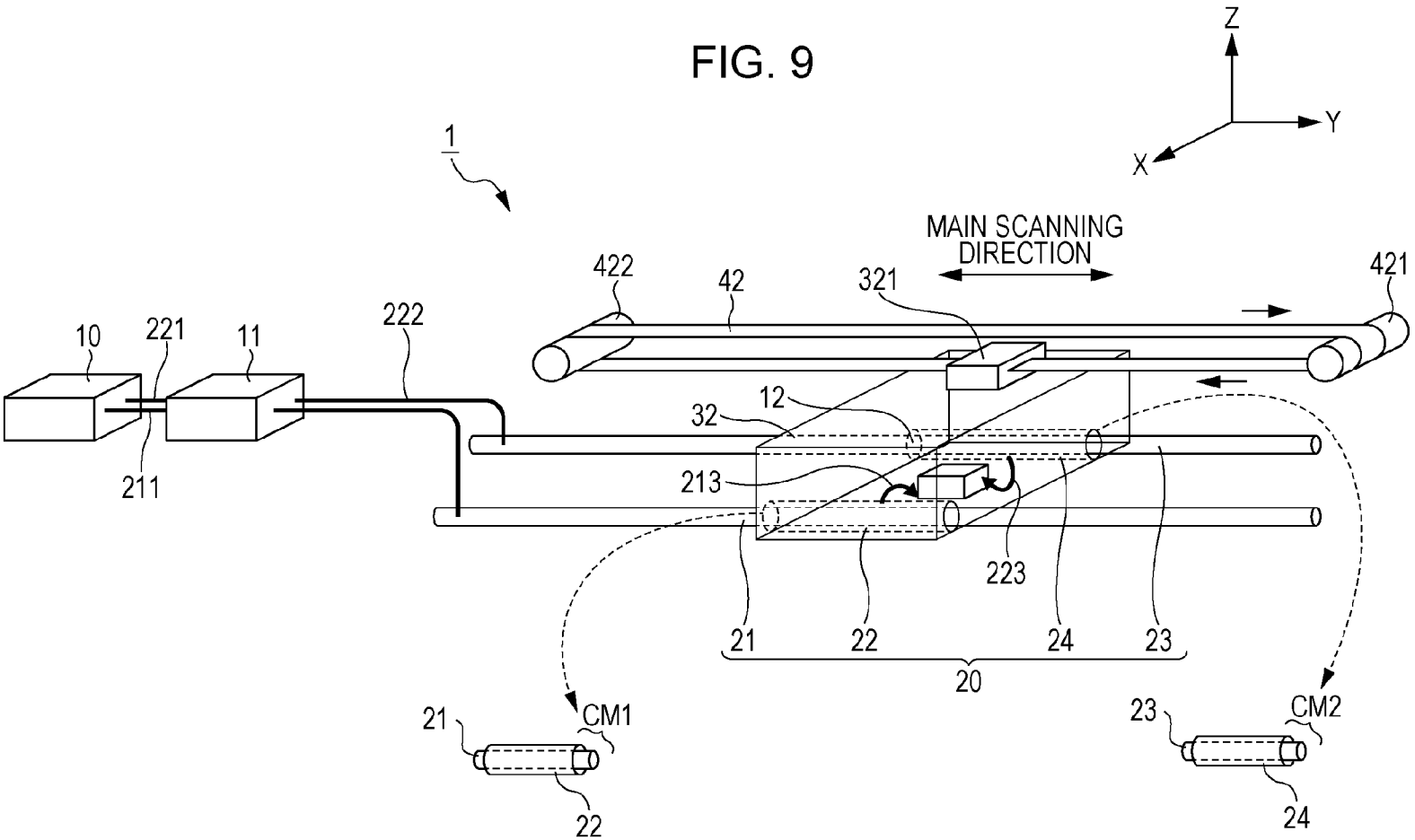
FIG. 9 is a view illustrating a power supplying path and a discharging path of a power transmission portion.

FIG. 9 is a view illustrating the power supplying path and the discharging path of the power transmission portion 2. As illustrated in FIG. 9, the power source unit 10 is electrically connected to the power transmission circuit 11 via a power supplying path 211, and is electrically connected to the power transmission circuit 11 via a discharging path 221. By supplying the first power source signal to the power supplying path 211, and by supplying the second power source signal to the discharging path 221, the power source unit 10 applies the power supply voltage to the power transmission circuit 11.

The power transmission circuit 11 is electrically connected to the first carriage guide axis 21 via a power supplying path 212, and is electrically connected to the second carriage guide axis 23 via a discharging path 222.

As illustrated in FIG. 9, the first carriage guide axis 21 is inserted through the conductive member (high order) 22 which is the bearing provided in the carriage 32, and the second carriage guide axis 23 is inserted through the conductive member (low order) 24 which is the bearing provided in the carriage 32. Accordingly, the carriage 32 is supported to be movable in the Y-axis direction, by the first carriage guide axis 21 and the second carriage guide axis 23.

Here, the first carriage guide axis 21 and the conductive member (high order) 22 form the coupling capacitance CM1 by the electric field coupling, and the capacitor value of the coupling capacitance CM1 is retained as a substantially constant value even when the carriage 32 reciprocates in the main scanning direction. Similarly, the second carriage guide axis 23 and the conductive member (low order) 24 form the coupling capacitance CM2 by the electric field coupling, and the capacitor value of the coupling capacitance CM2 is retained as a substantially constant value even when the carriage 32 reciprocates in the main scanning direction.

In addition, the conductive member (high order) 22 is electrically connected to the power receiving circuit 12 via a power supplying path 213, and the conductive member (low order) 24 is electrically connected to the power receiving circuit 12 via a discharging path 223.

Furthermore, although this will be described in detail later, the power receiving circuit 12 (refer to FIG. 10) is electrically connected to the head unit 5 via a power supplying path 214 (refer to FIG. 10), and the power receiving circuit 12 is electrically connected to the head unit 5 via a discharging path 224 (refer to FIG. 10).

In this manner, in the embodiment, the power supplying path is formed by the power supplying paths 211 to 214 and the coupling capacitance CM1, and the discharging path is formed by the discharging paths 221 to 224 and the coupling capacitance CM2. In other words, a part of the power supplying path is configured of the coupling capacitance CM1, and a part of the discharging path is configured of the coupling capacitance CM2. For this reason, it is possible to perform transmission of the power to the mounted object EB, such as the head unit 5, which is mounted in the carriage 32, from the power source unit 10, in a non-contact manner (wirelessly).

In this manner, the wireless transmission portion 20 transmits at least a part of the power supplied from the power source unit 10 to the mounted object EB, such as the head unit 5, via the coupling capacitance CM1 and the coupling capacitance CM2 by the electric field coupling.

For this reason, in the ink jet printer 1 according to the embodiment, it is possible to transmit the power to the head unit 5 which is mounted on the carriage 32 as the mounted object EB, from the power source unit 10 provided on an outer side (housing 31 side) of the carriage 32, without providing wiring, such as an FFC.

As described above, in the ink jet printer in the related art, the power is transmitted to the head unit which is mounted on the carriage from the power source mounted on the housing by using the physical wiring, such as the FFC. In the ink jet printer in the related art, when the carriage reciprocates in the main scanning direction, the FFC receives a physical defect. In addition, in the ink jet printer in the related art, there is a case where noise which is generated as the FFC moves in accordance with reciprocation of the carriage is spread to the control signal sent to the head unit.

There is a case where such a defect due to the presence of the FFC causes a malfunction of the ink jet printer, or causes deterioration of a quality of the image which is printed by the ink jet printer.

In contrast, in the ink jet printer 1 according to the embodiment, it is possible to transmit the power without using the FFC. Accordingly, it is possible to solve various defects which are associated with the FFC, to enhance a quality of printing compared to the ink jet printer in the related art which transmits the power to the head unit by using the FFC, and to reduce frequency of malfunction of the ink jet printer 1.

FIG. 10 is an example of an equivalent circuit diagram of the power transmission portion 2.

As illustrated in FIG. 10, as the power source unit outputs a first power source signal VS1 to the power supplying path 211 from a terminal TE01, and outputs a second power source signal VS2 to the discharging path 221 from a terminal TE02, between a terminal TE11 and a terminal TE12 of the power transmission circuit 11, a power supply voltage VS which is a potential difference between a potential illustrating the first power source signal VS1 and a potential illustrating the second power source signal VS2 is applied.

As illustrated in FIG. 10, the power transmission circuit 11 includes a capacitance C1 provided between the terminal TE11 and the terminal TE12, an inductor L1 which is connected to the capacitance C1 in parallel, the capacitance C2 which is provided between a terminal TE13 and a terminal TE14, and an inductor L2 which is connected to the capacitance C2 in parallel. The inductor L1 and the inductor L2 are magnetically coupled with each other, a magnetic field is generated by the electromagnetic induction if the size of the current which flows in the inductor L1 changes, and an induced electromotive force is generated in the inductor L2 by the magnetic field. The inductor L1 and the inductor L2 function as transformers.

As illustrated in FIG. 10, the terminal TE13 of the power transmission circuit 11 is electrically connected to the first carriage guide axis 21 which is one electrode of the coupling capacitance CM1, via the power supplying path 212, and the terminal TE14 of the power transmission circuit is electrically connected to the second carriage guide axis 23 which is one electrode of the coupling capacitance CM2, via the discharging path 222.

The conductive member (high order) 22 which is the other electrode of the coupling capacitance CM1 is electrically connected to a terminal TE21 of the power receiving circuit 12, via the power supplying path 213. In addition, the conductive member (low order) 24 which is the other electrode of the coupling capacitance CM2 is electrically connected to a terminal TE22 of the power receiving circuit 12, via the discharging path 223.

As illustrated in FIG. 10, the power receiving circuit 12 includes a capacitance C3 which is provided between the terminal TE21 and the terminal TE22, an inductor L3 which is connected to the capacitance C3 in parallel, a capacitance C4 which is provided between a terminal TE23 and a terminal TE24, and an inductor L4 which is connected to the capacitance C4 in parallel. The inductor L3 and the inductor L4 are magnetically coupled with each other, a magnetic field is generated by the electromagnetic induction if the size of the current which flows in the inductor L3 changes, and an induced electromotive force is generated in the inductor L4 by the magnetic field. The inductor L3 and the inductor L4 function as transformers.

By outputting a first output signal Vout1 to the power supplying path 214 from the terminal TE23, and by outputting a second output signal Vout2 to the discharging path 224 from the terminal TE24, the power receiving circuit applies an output voltage Vout which is a potential difference between a potential illustrating the first output signal Vout1 and a potential illustrating the second output signal Vout2, between a terminal TE31 and a terminal TE32 of the head unit 5.

In addition, in the embodiment, each inductance of the inductor L2 and the inductor L3, and each capacitance value of the capacitance C2 and the capacitance C3, are determined so that a resonance frequency of an LC circuit which is configured of the inductor L2 and the capacitance C2 and a resonance frequency of an LC circuit which is configured of the inductor L3 and the capacitance C3 are substantially the same as each other. In this case, in the power transmission portion 2, it is possible to enhance transmission efficiency of the power.

4. Regarding Transmission Efficiency of Power Transmission Portion

Next, with reference to FIGS. 11 to 15, the transmission efficiency of the power by the power transmission portion 2 will be described. In addition, in FIG. 11, an internal resistance RS of the power source unit 10 illustrated in FIG. 15 is illustrated, and an electrical resistance RL between the terminal TE31 and the terminal TE32 of the head unit 5 is illustrated.

Figure 11:
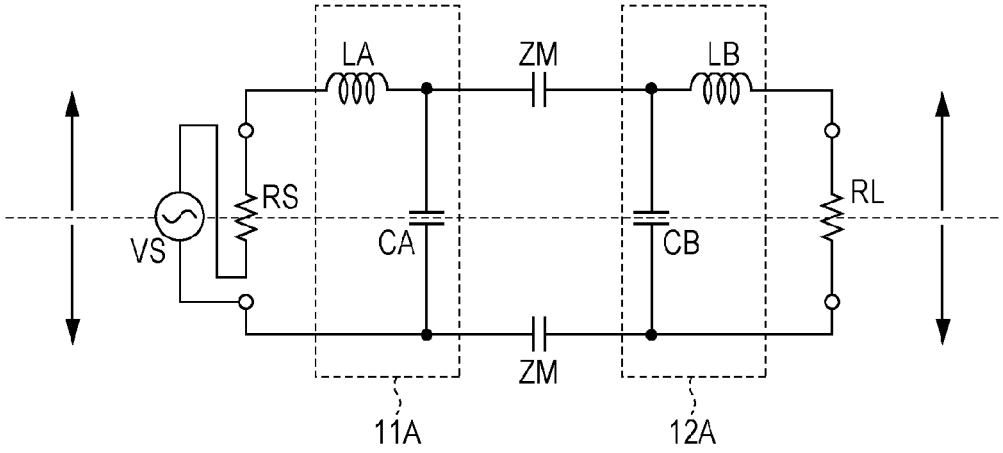
FIG. 11 is a view illustrating operations of the power transmission portion.

In addition, in FIG. 11, the power transmission circuit 11 is expressed as a circuit 11A which has an inductor of an inductance LA and a capacitance of capacitance value CA, and is equivalent to the power transmission circuit 11. The power receiving circuit 12 is expressed as a circuit 12A which has an inductor of an inductance LB and a capacitance of a capacitance value CB, and is equivalent to the power receiving circuit 12.

Furthermore, in FIG. 11, if the capacitance values of the coupling capacitance CM1 and the coupling capacitance CM2 which are illustrated in FIG. 10 are equivalent to each other, both an impedance of the coupling capacitance CM1 and an impedance of the coupling capacitance CM2 are expressed as an impedance ZM.

Figure 12:
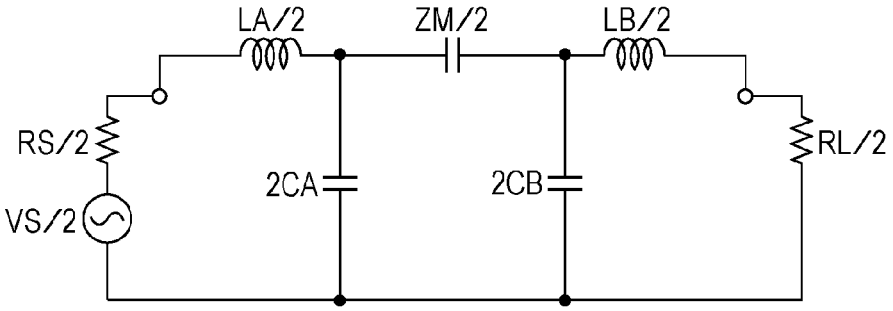
FIG. 12 is a view illustrating the operations of the power transmission portion.

For convenience of calculation, FIG. 12 is a circuit which splits the circuit illustrated in FIG. 11 into two circuits, including an upper circuit and a lower circuit, by considering a center potential VC between the potential of the first power source signal VS1 and the potential of the second power source signal VS2 which are generated by the power source unit 10 as a reference.

Here, for convenience of calculation, various values in the circuit illustrated in FIG. 12 are switched as follows.

$$RS/2=RL/2=z0 \quad \text{Formula (1)}$$

$$LA/2=LB/2=L \quad \text{Formula (2)}$$

$$2CA=2CB=C \quad \text{Formula (3)}$$

$$ZM/2=R \quad \text{Formula (4)}$$

Figure 13:
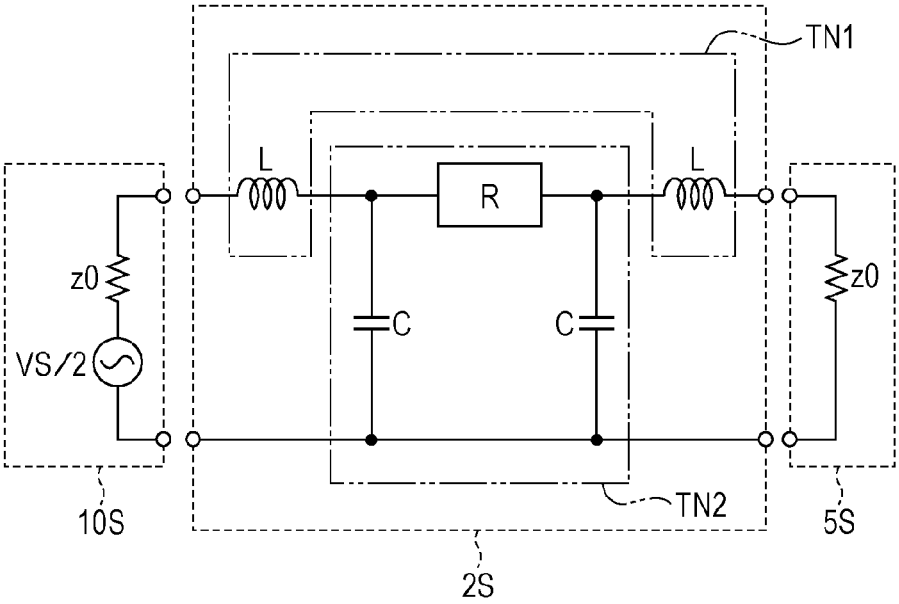
FIG. 13 is a view illustrating the operations of the power transmission portion.

In this case, the circuit illustrated in FIG. 12 can be expressed as a circuit illustrated in FIG. 13 which is equivalent to the circuit illustrated in FIG. 12.

In FIG. 13, a circuit 10S corresponds to one of the two circuits split from the power source unit 10 by considering the center potential VC as a reference, a circuit (two-terminal-pair circuit) 2S corresponds to one of the power supplying path and the discharging path in the power transmission portion 2, and a circuit 5S corresponds to one of the two resistances split from the resistance RL between the terminal TE31 and the terminal TE32 of the head unit 5 by considering the center potential VC as a reference.

Hereinafter, as a value which illustrates the transmission efficiency of the power by the two-terminal-pair circuit 2S, a voltage transmission coefficient and a power transmission coefficient of the two-terminal-pair circuit 2S are obtained.

Here, the voltage transmission coefficient is a value illustrating a ratio (voltage gain) of the voltage which is output from an output end, with respect to the voltage applied to an input end of the two-terminal-pair circuit. In addition, the power transmission coefficient is a value illustrating a ratio (power gain) of the power which is output from the output end, with respect to the power which supplied to the input end of the two-terminal-pair circuit.

The voltage transmission coefficient of the two-terminal-pair circuit is expressed by a component on a second column and a first row in a scattering matrix having two columns and two rows illustrating transferring properties of the two-terminal-pair circuit. In addition, the power transmission coefficient of the two-terminal-pair circuit is expressed as a square of an absolute value of the component on the second column and the first row of the scattering matrix. The scattering matrix of the two-terminal-pair circuit which is necessary for obtaining the voltage transmission coefficient and the power transmission coefficient can be obtained from an impedance matrix of the two-terminal-pair circuit.

Hereinafter, first, by calculating an impedance matrix Z of the two-terminal-pair circuit 2S, and then, by calculating a scattering matrix S of the two-terminal-pair circuit 2S, the voltage transmission coefficient and the power transmission coefficient of the two-terminal-pair circuit 2S are obtained.

The two-terminal-pair circuit 2S illustrated in FIG. 13 is made of a two-terminal-pair circuit TN1 and a two-terminal-pair circuit TN2. Specifically, as illustrated in FIG. 14, the two-terminal-pair circuit 2S is connected to the two-terminal-pair circuit TN1 and the two-terminal-pair circuit TN2 in series.

If an impedance matrix of the two-terminal-pair circuit TN1 is Z1, and an impedance matrix of the two-terminal-pair circuit TN2 is Z2, the impedance matrix Z of the two-terminal-pair circuit 2S can be determined based on the following Formula (5).

$$Z=Z1+Z2 \quad \text{Formula(5)}$$

Figure 14:
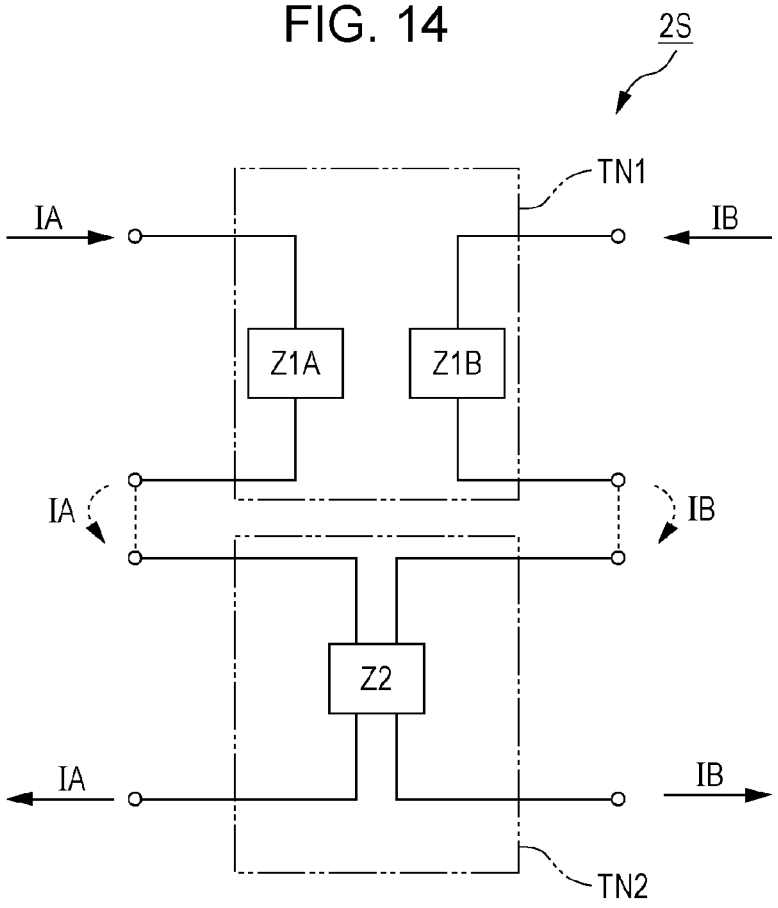
FIG. 14 is a view illustrating the operations of the power transmission portion.
Figure 15:
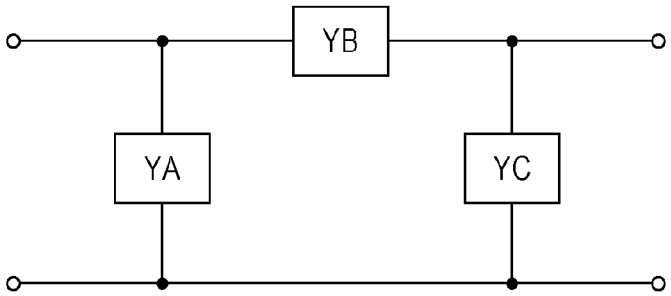
FIG. 15 is a view illustrating the operations of the power transmission portion.

The impedance matrix Z1 of the two-terminal-pair circuit TN1 illustrated in FIG. 14 is expressed by the following Formula (6), by an impedance Z1A and an impedance Z1B.

$$Z_1=\begin{bmatrix} Z_{1A} & 0 \\ 0 & Z_{1B} \end{bmatrix} \quad \text{Formula (6)}$$

The impedance Z1A and the impedance Z1B are respectively impedances according to an inductance L. Accordingly, the impedance Z1A and the impedance Z1B are expressed by the following Formula (7), by using an imaginary unit j, and an angular frequency W of the power supply voltage VS.

$$Z1A=Z1B=j\omega L \quad \text{Formula(7)}$$

In other words, by substituting Formula (7) for Formula (6), the impedance matrix Z1 can be expressed by the following Formula (8).

$$Z_1 = \begin{bmatrix} j\omega L & 0 \\ 0 & j\omega L \end{bmatrix} \quad \text{Formula (8)}$$

Next, the impedance matrix Z2 of the two-terminal-pair circuit TN2 is obtained as an inverse matrix of an admittance matrix Y2 of the two-terminal-pair circuit TN2.

An admittance matrix Y of the two-terminal-pair circuit which is provided with admittances YA, YB, and YC that are illustrated in FIG. 15, is expressed by the following Formula (9).

$$Y = \begin{bmatrix} Y_A + Y_B & -Y_B \\ -Y_B & Y_B + Y_C \end{bmatrix} \quad \text{Formula (9)}$$

The admittance of a capacitance C which is an element of the two-terminal-pair circuit TN2 illustrated in FIG. 13 corresponds to the admittances YA and YC of the two-terminal-pair circuit illustrated in FIG. 15, and is expressed by the following Formula (10).

$$YA=YC=j\omega C \quad \text{Formula (10)}$$

Similarly, the admittance of a resistance R which is an element of the two-terminal-pair circuit TN2 corresponds to the admittance YB of the two-terminal-pair circuit illustrated in FIG. 15, and is expressed in the following Formula (11).

$$YB=1/R \quad \text{Formula (11)}$$

Accordingly, the admittance matrix Y2 of the two-terminal-pair circuit TN2 substitutes Formulas (10) and (11) with respect to Formula (9), and is expressed by Formula (12).

$$Y_2 = \frac{1}{R}\begin{bmatrix} 1 + j\omega CR & -1 \\ -1 & 1 + j\omega CR \end{bmatrix} \quad \text{Formula (12)}$$

The impedance matrix Z2 of the two-terminal-pair circuit TN2 can be obtained as the inverse matrix of the admittance matrix Y2 expressed in Formula (12). For this reason, the impedance matrix Z of the two-terminal-pair circuit 2S is obtained as the following Formula (13).

$$Z = j\omega L\begin{bmatrix} 1 & 0 \\ 0 & 1 \end{bmatrix} + Y_2^{-1} \quad \text{Formula (13)}$$

The scattering matrix S is generally expressed by the following Formula (14) by using the impedance matrix Z and a unit matrix I having two columns and two rows.

$$S = \frac{Z - z_0 I}{Z + z_0 I} \quad \text{Formula (14)}$$

In addition, in the embodiment, for performing the power transmission with high efficiency by using an LC resonance phenomenon as described above, the inductance L illustrated in Formula (2) and the capacitance value C illustrated in Formula (3) are determined to satisfy a resonance condition illustrated in the following Formula (15).

$$\omega^2 LC=1 \quad \text{Formula(15)}$$

Therefore, by Formulas (12) to (15), among each component of the scattering matrix S expressed by the following Formula (16), a component s21 on a second column and a first row can be obtained. The component s21 is a value which illustrates the voltage transmission coefficient of the two-terminal-pair circuit 2S, and is expressed by the following Formula (17).

$$S = \begin{bmatrix} s_{11} & s_{12} \\ s_{21} & s_{22} \end{bmatrix} \quad \text{Formula (16)}$$

$$s_{21} = \frac{2}{2j\omega Cz_0 - 2 - \omega^2 C^2 Rz_0} \quad \text{Formula (17)}$$

In addition, as described above, the power transmission coefficient of the two-terminal-pair circuit 2S is a square of the absolute value of the component s21, that is, $|s\mathbf{21}|^2$, and is expressed by the following Formula (18).

$$|s_{21}|^2 = \frac{4}{\left(\frac{2z_0}{\omega L}\right)^2 + 4 + \frac{4Rz_0}{\omega^2 L^2} + \left(\frac{Rz_0}{\omega^2 L^2}\right)^2} \quad \text{Formula (18)}$$

In the embodiment, in order to increase the voltage transmission coefficient and the power transmission coefficient, as the following Formula (19) is valid, each constituent element of the power source unit 10, the power transmission portion 2, and the head unit 5 is designed.

$$z0 \ll R \ll \omega L \quad \text{Formula (19)}$$

On the assumption that Formula (19) is valid, the value $|s\mathbf{21}|^2$ which is expressed by Formula (18) is approximated to a value expressed by the following Formula (20). In this case, the value $|s\mathbf{21}|^2$ of the power transmission coefficient is a value which is substantially close to "1", and the power transmission portion 2 has high transmission efficiency.

$$|s_{21}|^2 \approx 1 - \frac{Rz_0}{\omega^2 L^2} \quad \text{Formula (20)}$$

Hereinafter, a condition which is necessary for fulfilling the above-described Formula (19) will be reviewed.

First, "z0<<R" in Formula (19) will be reviewed.

In general, the resistance RS of the power source unit 10 which corresponds to an impedance z0 can be set to be a small value. In addition, in general, the impedance ZM according to the coupling capacitance (CM1, CM2) is set to be a large value. Accordingly, in general, the condition "Z0<<R" is fulfilled.

Next, "R<<ωL" in Formula (19) will be reviewed.

When the capacitance values of the coupling capacitance CM1 and the coupling capacitance CM2 are set to be CM, an impedance R (impedance ZM) is expressed by the following Formula (21) by using the capacitance value CM.

$$R = \frac{1}{j\omega C_M} \quad \text{Formula (21)}$$

By Formulas (15) to (21), the following Formula (22) is obtained. In addition, by Formulas (20) to (22), the following Formula (23) is obtained.

$$\frac{R}{\omega L} = \frac{C}{C_M} \quad \text{Formula (22)}$$

$$|s_{21}|^2 \approx 1 - \frac{C}{C_M}\frac{z_0}{\omega L} \quad \text{Formula (23)}$$

As being apparent from Formula (22), in order to fulfill the condition "R<<ωL", the capacitance values CM of the coupling capacitance CM1 and the coupling capacitance CM2 may be determined to be sufficiently greater than the capacitance value CA of the capacitance provided in the power transmission circuit 11, and the capacitance value CB of the capacitance provided in the power receiving circuit 12. In this case, as illustrated in Formula (23), a value $|s21|^2$ of the power transmission coefficient becomes a value substantially close to "1".

Here, in the ink jet printer 1 according to the embodiment, the coupling capacitance CM1 is formed by using the above-described first carriage guide axis 21 and the conductive member (high order) 22 which functions as a bearing thereof, and the coupling capacitance CM2 is formed by using the second carriage guide axis 23 and the conductive member (low order) 24 which functions as a bearing thereof.

However, it is known that a so-called concentric cylindrical capacitor is more likely to have a greater capacity of the coupling capacitance than that of a so-called parallel plate capacitor. In other words, the so-called concentric cylindrical capacitor can obtain smaller dimensions and a greater coupling capacitance than those of the so-called parallel plate capacitor.

Therefore, similarly to the ink jet printer 1 according to the embodiment, by forming the coupling capacitance CM1 by using the first carriage guide axis 21 and the conductive member (high order) 22 which functions as a bearing thereof, and by forming the coupling capacitance CM2 by using the second carriage guide axis 23 and the conductive member (low order) 24 which functions as a bearing thereof, it is easy to make the capacitance values CM of the coupling capacitance CM1 and the coupling capacitance CM2 sufficiently greater than the capacitance value CA of the capacitance provided in the power transmission circuit 11 and the capacitance value CB of the capacitance provided in the power receiving circuit 12.

Furthermore, in the ink jet printer 1 according to the embodiment, by providing the insulator 120 and the lubricating layer 130 which are made of a material having higher permittivity than air between the first carriage guide axis 21 and the conductive member (high order) 22 which functions as a bearing thereof and between the second carriage guide axis 23 and the conductive member (low order) which functions as a bearing thereof, the capacitance value CM is set be much greater. In this manner, according to the embodiment, it is possible to sufficiently and easily increase the capacitance value CM with respect to the capacitance value CA and the capacitance value CB.

In addition, instead of providing the insulator 120 on the outer circumferential surfaces of each of the first carriage guide axes 21 and 23, by coating the outer circumferential surfaces of each of the first carriage guide axes 21 and 23 with a coating material which is made of an insulating material, and by covering the surfaces with an insulating material, it is possible to further shorten a distance between each of the carriage guide axes 21 and 23 and each of the conductive members 22 and 24, and to obtain much greater capacitance value CM.

5. Regarding Head Driving Circuit 50

Next, with reference to FIG. 16, a configuration and operations of the head unit 5 will be described.

Figure 16:
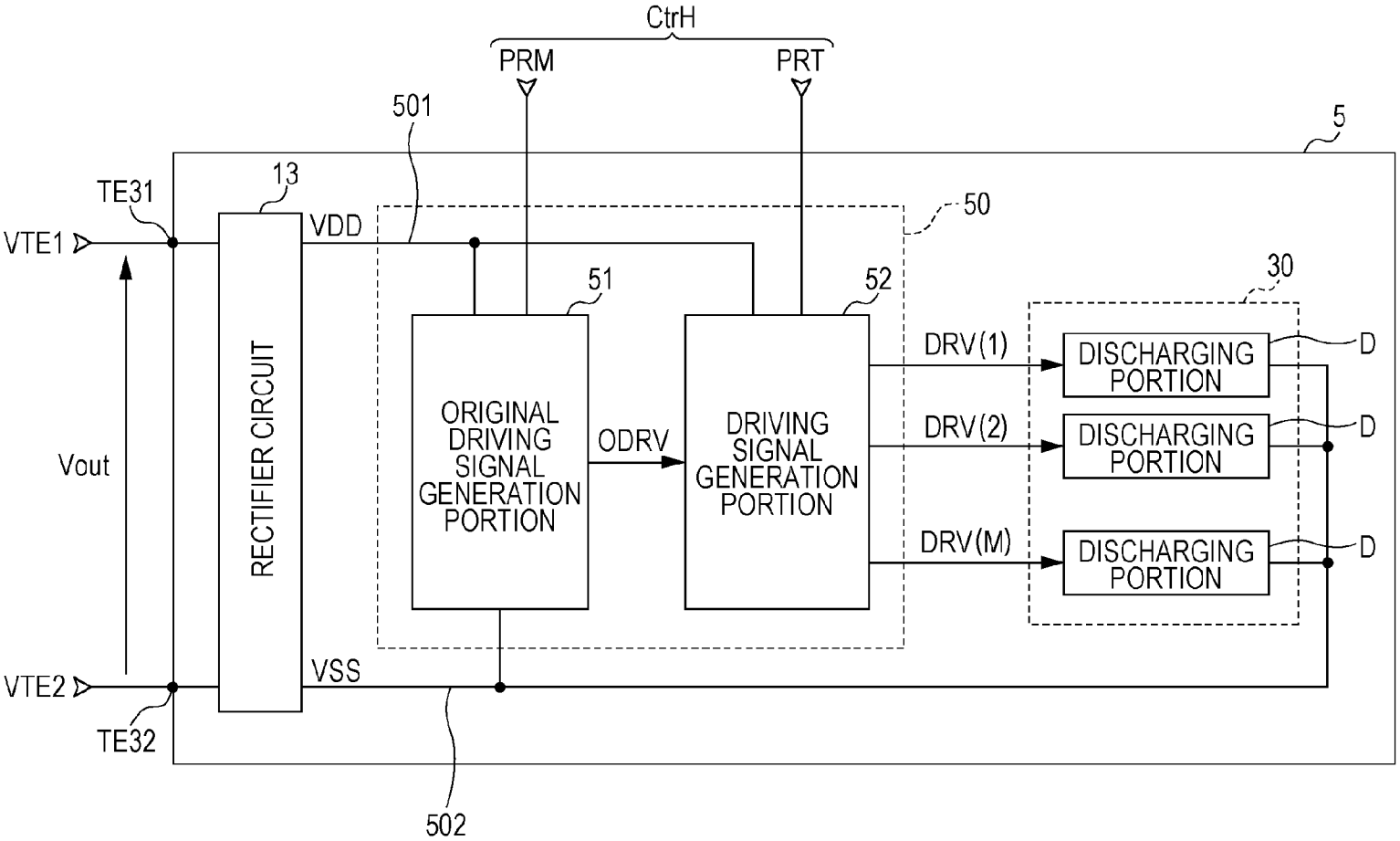
FIG. 16 is a block diagram illustrating a configuration of a head unit.

FIG. 16 is an example of an equivalent circuit diagram of the head unit 5. As illustrated in FIG. 16, the head unit 5 includes a rectifier circuit 13, the head driving circuit 50, and the head 30.

The rectifier circuit 13 is, for example, an AC-DC converter, and converts the output voltage Vout which is the AC voltage supplied from the power transmission portion 2 into a DC voltage. Specifically, the rectifier circuit 13 sets a potential of a power supply line 501 which is the power supplying path as a constant potential VDD on the high order side, and sets a potential of a power supply line 502 which is the discharging path as the reference potential VSS which is lower than the potential VDD.

The head driving circuit 50 includes an original driving signal generation portion 51 and a driving signal generation portion 52. The head driving circuit 50 supplies the driving signal DRV with respect to each of M discharging portions D. In addition, in FIG. 16, numbers in parentheses at the end of names of each signal illustrate numbers of the discharging portions D to which the signal is supplied.

In addition, the head unit 5 may be provided with four head driving circuits 50 to correspond to four nozzle rows one for one, and may be provided with one head driving circuit 50 which is common with respect to M discharging portions D.

The original driving signal generation portion 51 generates an original driving signal ODRV based on a parameter for generating an original driving signal PRM which is included in the control signal CtrH supplied from the CPU 6. In addition, the parameter for generating an original driving signal PRM is a parameter for regulating a shape of a waveform of the original driving signal ODRV.

The original driving signal generation portion 51 is electrically connected to each of the power supply line 501 which is the power supplying path and the power supply line 502 which is the discharging path.

Figure 17:
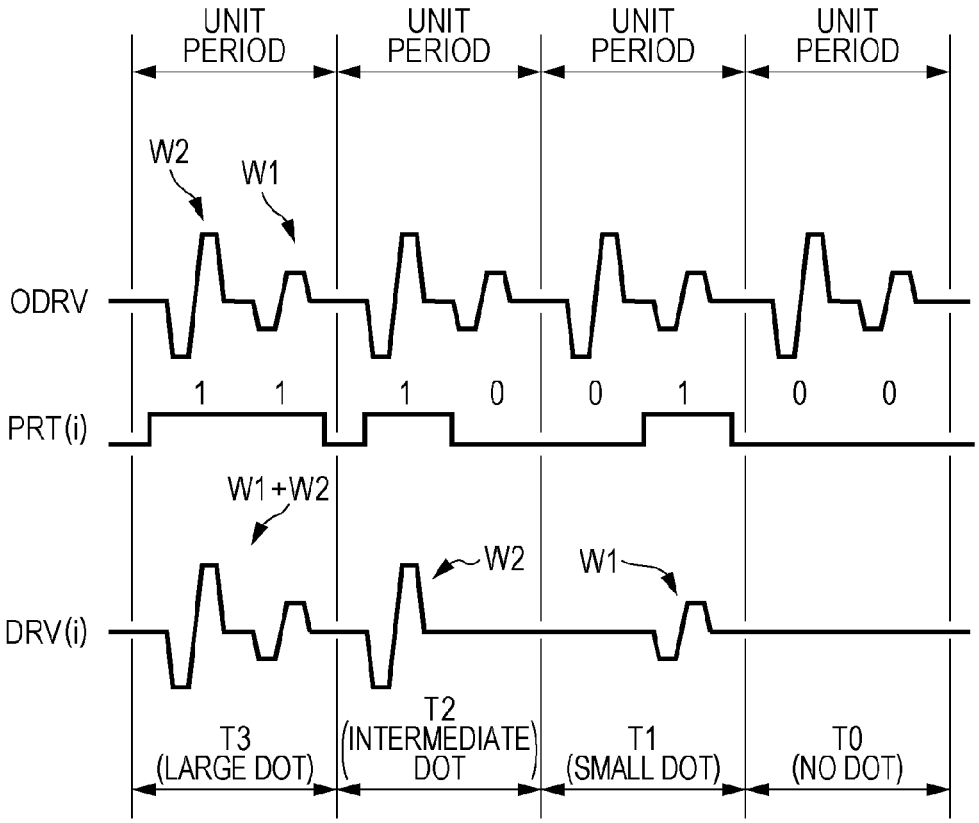
FIG. 17 is a view illustrating an original driving signal ODRV, a printing signal PRT, and a driving signal DRV.

FIG. 17 is a view illustrating an example of a waveform of the original driving signal ODRV, a printing signal PRT (i), and a driving signal DRV (i). The original driving signal ODRV is a signal which includes two pulses, including a first pulse W1 and a second pulse W2, every unit period (period when the carriage 32 cuts across an interval of one pixel).

Based on the printing signal PRT which is included in the control signal CtrH supplied from the CPU 6, and the original driving signal ODRV, in the driving signal generation portion 52, the driving signal DRV is generated. The printing signal PRT is a signal which is generated by the CPU 6 based on the printing data PD, and is a signal which regulates whether or not the ink is discharged from the discharging portion D with respect to each pixel, and a discharge amount of the ink when the ink is discharged from the discharging portion D.

More specifically, the driving signal generation portion 52 generates the driving signal DRV (i) by making the original driving signal ODRV be blocked or pass based on the printing signal PRT (i) which corresponds to an i-th discharging portion D among M discharging portions D.

For example, as illustrated in FIG. 17, in a case where the printing signal PRT (i) is a two-bit signal, when a value which illustrates the printing signal PRT (i) is "00", the driving signal generation portion 52 blocks both the pulses W1 and W2 of the original driving signal ODRV. When the value which illustrates the printing signal PRT (i) is "01", only the pulse W1 is blocked and the pulse W2 passes. When the value which illustrates the printing signal PRT (i) is "10", only the pulse W2 is blocked and the pulse W1 passes. When the value which illustrates the printing signal PRT (i) is "11", both the pulses W1 and W2 pass. The driving signal generation portion 52 supplies the passed pulse as the driving signal DRV (i) to the upper electrode 302 of the piezoelectric element 300 which is provided in the i-th discharging portion D. The i-th discharging portion D is driven based on the driving signal DRV (i) from the driving signal generation portion 52.

The driving signal generation portion 52 is electrically connected respectively to the power supply line 501 which is the power supplying path and the power supply line 502 which is the discharging path. In addition, in each discharging portion D, the upper electrode 302 of the piezoelectric element 300 is electrically connected to the driving signal generation portion 52 and receives the supply of the driving signal DRV (i), and the lower electrode 301 is electrically connected to the power supply line 502 which is the discharging path.

In addition, although not illustrated in the drawings, the head driving circuit 50 may include a DC-DC converter which converts the voltage determined by the potential VDD and the reference potential VSS into an appropriate voltage that is necessary in each portion of the head driving circuit 50.

6. Conclusion of Embodiment

As described above, in the ink jet printer 1 according to the embodiment, it is possible to transmit the power to the mounted object EB, such as the head unit 5, which is mounted on the carriage 32 without using the FFC. For this reason, compared to the ink jet printer in the related art which transmits the power by using the FFC to the head unit, it is possible to improve a quality of printing, and further, to reduce frequency of malfunction of the ink jet printer 1.

In addition, in the ink jet printer 1 according to the embodiment, since the power source unit 10 supplies the power which has an appropriate size in accordance with the type of the recording medium P, it is possible to lower power consumption of the ink jet printer 1, and to prevent shortage of the power supplied to the head unit 5.

Each embodiment described above can be modified in various manners. Specific modified aspects will be described hereinafter. Two or more aspects which are arbitrarily selected from the examples below, can be appropriately merged with each other within a range where there is no mutual conflict. In addition, in modification examples which will be described hereinafter, in order to avoid description from being repeated, description regarding points which are common to the above-described invention will be omitted.

Modification Example 1

In the above-described embodiment, in order to obtain the coupling capacitance CM1 on the power supplying path, the first carriage guide axis 21 and the conductive member (high order) 22 which functions as a bearing thereof are used, and in order to obtain the coupling capacitance CM2 on the discharging path, the second carriage guide axis 23 and the conductive member (low order) 24 which functions as a bearing thereof are used. However, the invention is not limited thereto.

In other words, at least one coupling capacitance among the coupling capacitance CM1 and the coupling capacitance CM2 may be formed by using the carriage guide axis and a conductive member which functions as a bearing thereof, and the other coupling capacitance may be provided in a state where the electric field coupling of a conductor having a substantially plate shape with the housing 31 and the carriage 32 is possible, and may be formed by using the conductor having a substantially plate shape.

Modification Example 2

Figure 18:
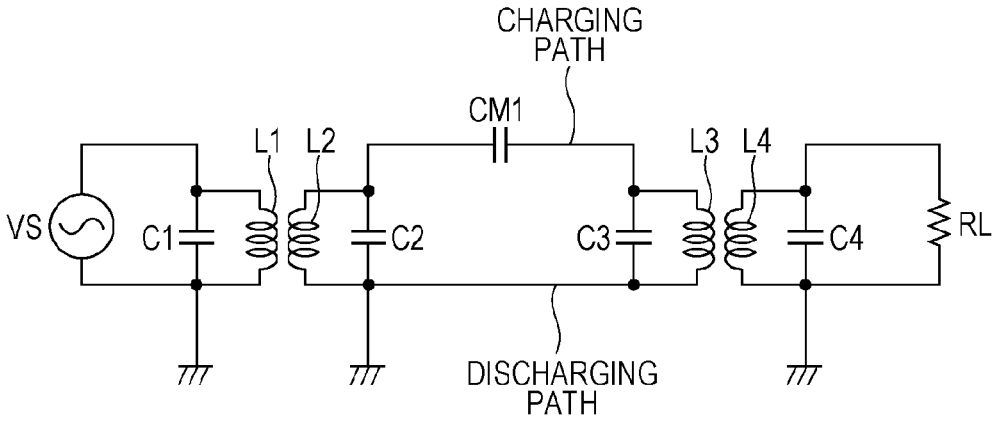
FIG. 18 is an equivalent circuit diagram of the power transmission portion according to a modification example.

In the above-described embodiment, the power transmission portion 2 includes the coupling capacitance CM1 on the power supplying path and the coupling capacitance CM2 on the discharging path. However, the invention is not limited thereto, and the power transmission portion 2 may include only one of the coupling capacitance CM1 and the coupling capacitance CM2. For example, as illustrated in FIG. 18, the power transmission portion 2 may set the discharging path to a ground potential, and may include the coupling capacitance CM1 only on the power supplying path. In the example illustrated in FIG. 18, for example, without providing the insulator 120 in the second carriage guide axis 23, and by setting the potential of the second carriage guide axis 23 to the ground potential and electrically connecting the terminal TE32 of the head unit 5 to the second carriage guide axis 23, the discharging path may be set to the ground potential. In addition, in the example illustrated in FIG. 18, a driving aspect of the power supplying path is similar to that in the above-described embodiment.

Modification Example 3

Figure 19:
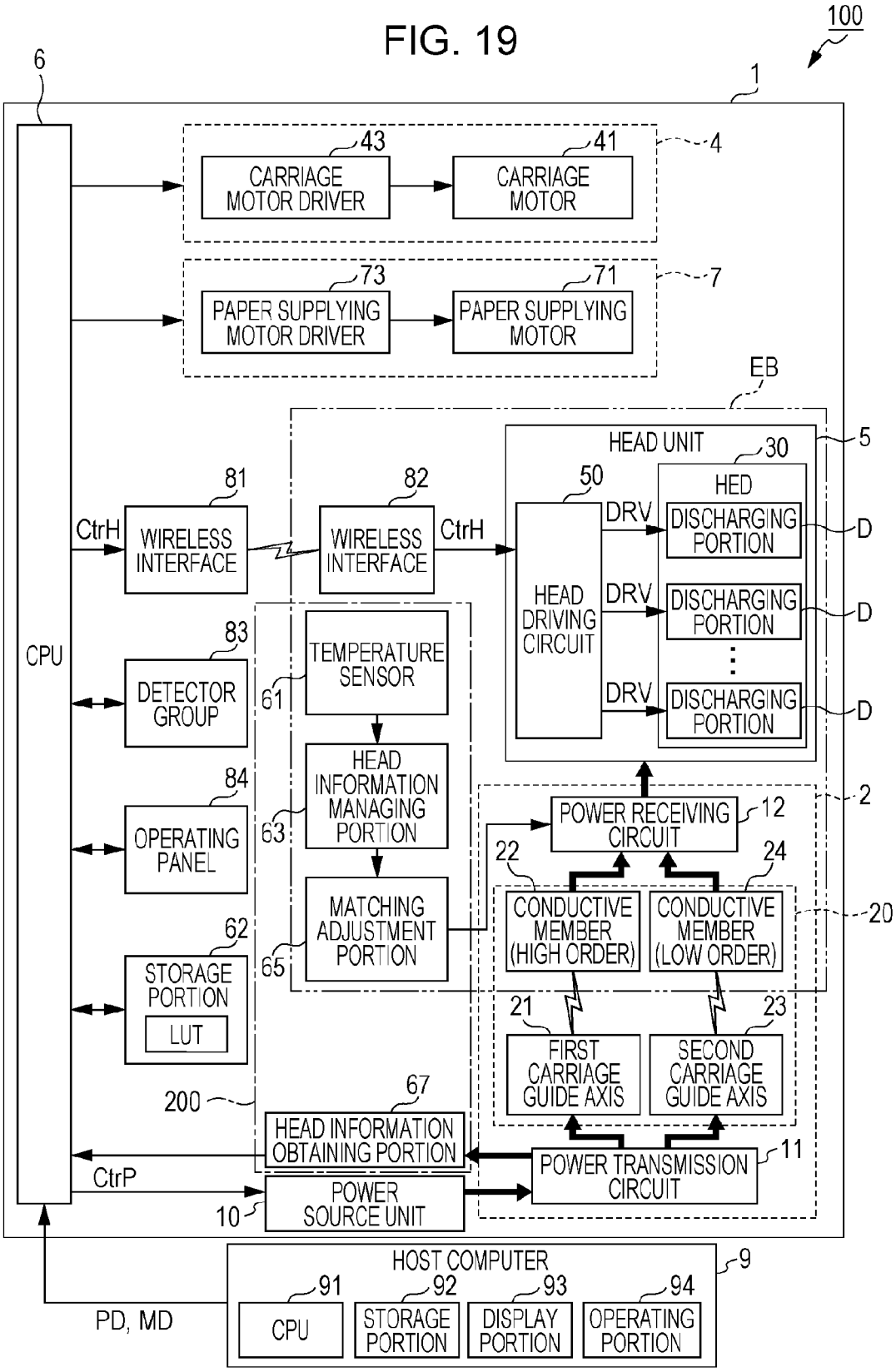
FIG. 19 is a block diagram illustrating the configuration of the ink jet printer according to the modification example.

FIG. 19 is a block diagram illustrating a configuration of the ink jet printer 1 according to the modification example. In the modification example, by aggregating and using head information Ih according to the head unit 5, a correction portion 200 for performing a control (hereinafter, referred to as a "correction control") which attenuates deviation of a landing position of the ink is provided in the ink jet printer 1.

The head information Ih may be any information if the information is related to the head unit 5. For example, the head information Ih is information which is related to the discharge of the ink, and is information which illustrates the temperature of the head unit 5. Viscosity of the ink changes in accordance with the temperature. Therefore, the temperature of the head unit 5 is information which is useful in controlling the discharge of the ink.

The correction portion 200 is configured of a head information obtaining portion 67 provided in the housing 31, and a temperature sensor 61, a head information managing portion 63, and a matching adjustment portion 65 that are provided in the carriage 32. Among these, the matching adjustment portion 65 and the head information obtaining portion 67 function as head information transmission portions which transmit the head information Ih to the CPU 6 via the power transmission portion 2 that functions as the power supplying path from the head information managing portion 63. In the embodiment, the head information Ih is transferred to the CPU 6 which is installed in the housing 31 from the carriage 32 via the power transmission portion 2 that functions as the above-described power supplying path. Therefore, a wireless module or the like for transmitting the head information Ih from the carriage 32 side to the CPU 6 which is installed in the housing 31, is not necessary.

Figure 20:
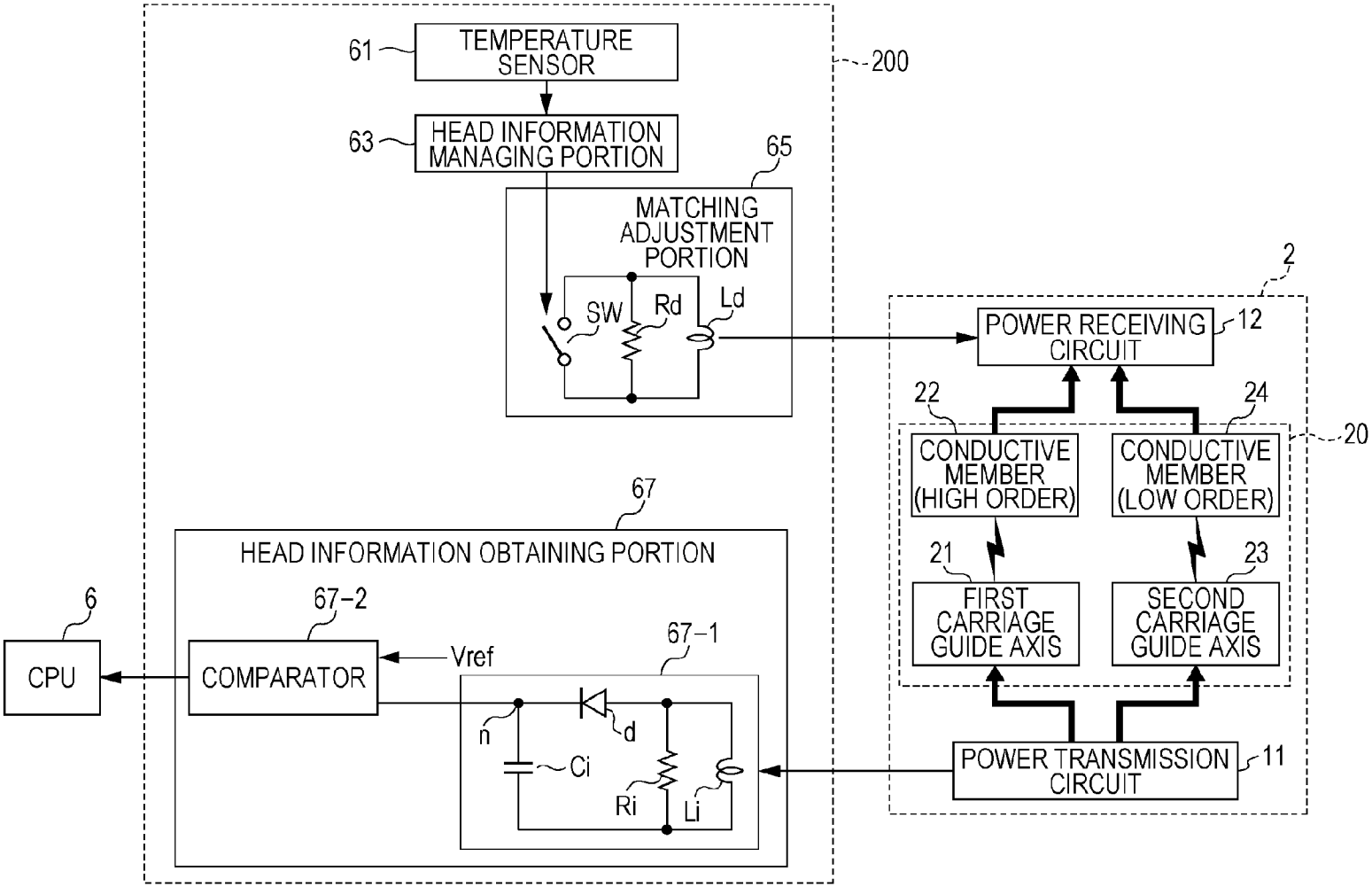
FIG. 20 is a block diagram illustrating a detailed configuration of a correction portion.

FIG. 20 illustrates a detailed configuration of the correction portion 200. In addition, FIG. 21 is a waveform view illustrating a process of transferring the head information Ih.

The temperature sensor 61 detects the temperature of the head unit 5, and outputs the temperature signal illustrating the temperature thereof. For example, the temperature sensor 61 supplies a constant current to a thermistor, and outputs a voltage of both ends of the thermistor as the temperature signal. By comparing the temperature signal to a threshold value, the head information managing portion 63 generates a switch control signal CTL1. Specifically, when the temperature signal is equal to or greater than the threshold value, and the temperature of the head unit 5 changes from a temperature which is lower than a predetermined temperature Tmp to a temperature which is equal to or higher than the predetermined temperature Tmp, only first time T1 makes the switch control signal CTL1 active. In addition, when the temperature signal is equal to or less than the threshold value, and the temperature of the head unit 5 changes from a temperature which is equal to or higher than the predetermined temperature to a temperature which is lower than the predetermined temperature, only second time T2 makes the switch control signal CTL1 active.

Figure 21:
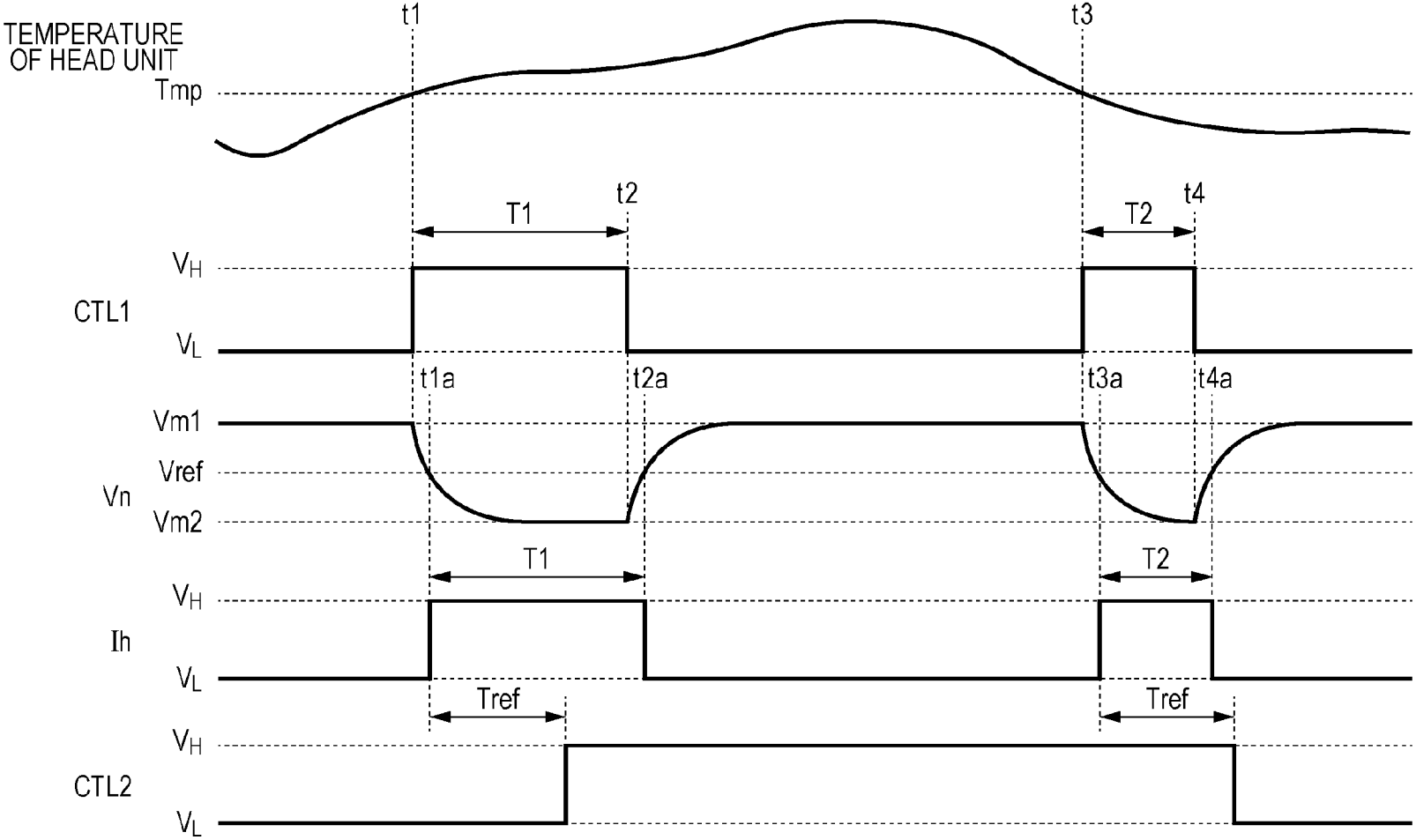
FIG. 21 is a waveform view illustrating a process of transferring head information.

In the example illustrated in FIG. 21, if the temperature of the head unit 5 at time t1 changes from the temperature which is lower than the predetermined temperature Tmp to the temperature which is equal to or higher than the predetermined temperature Tmp, the switch control signal CTL1 changes from a low level to a high level (active), and after the high level is maintained during the first time T1, the high level changes to the low level at time t2.

In addition, when the temperature of the head unit 5 at time t3 changes from the temperature which is equal to or higher than the predetermined temperature Tmp to the temperature which is lower than the predetermined temperature Tmp, the switch control signal CTL1 changes from the low level to the high level, and after the high level is maintained only during the second time T2, the high level changes to the low level at time t4.

A period of the high level (active) of the switch control signal CTL1 is a value which varies in accordance with the temperature change of the head unit 5. For this reason, the switch control signal CTL1 corresponds to the head information Ih which illustrates the temperature of the head unit 5.

Next, the matching adjustment portion 65 illustrated in FIG. 20 is provided with an inductance Ld, a resistance Rd, and a switch SW. The inductance Ld is inductively coupled to inductances L3 and L4 (inductance component LB in the equivalent circuit 12A) in the above-described power receiving circuit 12. Therefore, the resonance frequency of the power receiving circuit 12 is influenced by the inductance Ld.

The resistance Rd is provided in parallel with the inductance Ld with respect to the switch SW. The switch SW is ON when the switch control signal CTL1 becomes active, and is OFF when the switch control signal CTL1 becomes inactive.

If the switch SW is ON, the inductance Ld which is provided in the matching adjustment portion 65 becomes short-circuited. At this time, the current flows (flowing current increases) to the inductance Ld by the induced electromotive force generated to the inductance Ld, and influences the inductances L3 and L4 (inductance LB in the equivalent circuit 12A) in the above-described power receiving circuit 12. The resonance frequency (resonance frequency of the LC circuit which is configured of the LB and CB in the equivalent circuit 12A) of the LC circuit in the power receiving circuit 12 changes as the switch SW changes to be ON or OFF.

Next, a configuration of the head information obtaining portion 67 will be described. As illustrated in FIG. 20, the head information obtaining portion 67 includes a detection circuit 67-1 and a comparator 67-2. The detection circuit 67-1 includes an inductance Li, a resistance Ri, a diode d, and a capacitance Ci. The inductance Li is inductively coupled to the inductors L1 and L2 (inductance LA which is in the equivalent circuit 11A) of the above-described power transmission circuit 11. Therefore, the resonance frequency of the power transmission circuit 11 is determined by being influenced by the induced coupling of the inductance Li and the inductors L1 and L2. In addition, when the current flows to the inductors L1 and L2 of the power transmission circuit 11, the voltage is induced to the inductance Li. The resistance Ri is connected between both ends of the inductance Li. The diode d and the capacitance Ci are connected in series with the inductance Li and the resistance Ri, the induced electromotive force generated between both ends of the inductance Li is half-wave rectified, and a power signal Vn having a size in accordance with the feeding power is output.

The power signal Vn and a reference potential Vref are input into the comparator 67-2. The comparator 67-2 reproduces the head information Ih by comparing the power signal Vn to the reference potential Vref. The comparator 67-2 outputs the head information Ih which becomes the high level when the power signal Vn is equal to or lower than the reference potential Vref as illustrated in FIG. 21, and which becomes the low level when the power signal Vn is higher than the reference potential Vref. The head information Ih is input into the CPU 6.

In the example illustrated in FIG. 21, at the time t1, when the temperature of the head unit 5 changes from the temperature which is lower than the predetermined temperature Tmp to the temperature which is equal to or higher than the predetermined temperature Tmp, the switch control signal CTL1 becomes ON only during the first time T1. Then, as described above, the resonance frequency (resonance frequency of the LC circuit which is configured of the LB and the CB in the equivalent circuit 12A) of the LC circuit in the power receiving circuit 12 is deviated, and the transmission efficiency of the power in the power transmission portion 2 deteriorates.

Accordingly, the voltage between the terminal TE31 and the terminal TE32 of the head unit 5 decreases, the amount of the current which flows to the power transmission circuit 11 (equivalent circuit 11A) also decreases, and the induced electromotive force which is generated between both ends of the inductance Li of the detection circuit 67-1 also deteriorates. Therefore, the potential of the power signal Vn deteriorates. In the example, when the resonance frequency of the power receiving circuit 12 and the resonance frequency of the power transmission circuit 11 substantially match each other, while the power signal Vn becomes a potential Vm1, the switch control signal CTL1 becomes active, and when the resonance frequency of the power receiving circuit 12 is deviated from the resonance frequency of the power transmission circuit 11, the power signal Vn becomes a potential Vm2.

Specifically, when the potential of the power signal Vn is equal to or lower than the reference potential Vref at time t1*a*, the head information Ih is transited from the low level to the high level and maintains the high level only during the first time T1, and when the potential of the power signal Vn is higher than the reference potential Vref at time t2*a*, the head information Ih is transited from the high level to the low level.

Similarly, during a period from time t3*a* to time t4*a* passing the second time T2, the head information Ih becomes the high level.

In this manner, in the embodiment, when the temperature of the head unit 5 changes from the temperature which is lower than the predetermined temperature Tmp to the temperature which is equal to or higher than the predetermined temperature Tmp, and when the temperature of the head unit 5 changes from the temperature which is equal to or higher than the predetermined temperature Tmp to the temperature which is lower than the predetermined temperature Tmp, the result of the change is transferred to the CPU 6 as the head information Ih. Then, the power transmission portion 2 which is a transmission path of the power is used as the transmission path of the head information Ih.

The CPU 6 monitors the time when the head information Ih becomes the high level, and generates a correction control signal CTL2 which becomes the high level when the time is longer than a reference time Tref and becomes the low level when the time is shorter than the reference time Tref (refer to FIG. 21). Here, Tref=(T1+T2)/2 is set so that the reference time Tref can discriminate the first time T1 and the second time T2.

During the period (active) when the correction control signal CTL2 is at the high level, the CPU 6 generates a control signal which performs an appropriate known correction control in which the temperature of the head unit 5 is equal to or higher than the predetermined temperature Tmp, sends the control signal to the carriage 32 by the wireless interface 81, and supplies the control signal to the head driving circuit 50. Specifically, the control signal is, for example, the above-described original driving signal ODRV. The viscosity of the ink changes in accordance with the temperature, but by changing the original driving signal ODRV in accordance with the temperature, it is possible to constantly retain the discharge amount of the ink even when the temperature is changed.

In addition, in the head driving circuit 50, the driving signal DRV is generated from the original driving signal ODRV, and is supplied to each discharging portion D. However, when the temperature reaches a certain temperature, the head driving circuit 50 does not operate normally. By setting the predetermined temperature Tmp to be able to distinguish a normal operation and abnormal operation, the CPU 6 can detect that the head driving circuit 50 operates abnormally. In this case, when printing continues, the recording medium becomes wasteful. Here, the CPU 6 may stop the printing operation during the period when the correction control signal CTL2 is at the high level, and may stand by until the temperature of the head unit 5 decreases. In this case, the CPU 6 generates the control signal CtrH which is to stop printing, and supplies the control signal CtrH to the head driving circuit 50 via the wireless interfaces 81 and 82.

Modification Example 4

Shapes and disposition states of the first carriage guide axis 21, the second carriage guide axis 23, the conductive member (high order) 22, and the conductive member (low order) 24, are not limited to the examples illustrated in FIGS. 2 to 6. In other words, if the first carriage guide axis 21 and the conductive member (high order) 22 can form the electric field coupling, and if the second carriage guide axis 23 and the conductive member (low order) 24 can form the electric field coupling, the shapes or the disposition states are arbitrary. For example, parts of the first carriage guide axis 21 and the conductive member (high order) 22 may have planar shapes which face each other. Similarly, parts of the second carriage guide axis 23 and the conductive member (low order) 24 may have planar shapes which face each other.

Modification Example 5

In the above-described embodiment and modification examples, the ink jet printer 1 discharges the ink from the nozzles N by vibrating the piezoelectric element 300. However, the invention is not limited thereto. For example, a so-called thermal method in which bubbles are generated in the cavity 320 and pressure inside the cavity 320 is increased by heating a heat generator (not illustrated) provided in the cavity 320, and accordingly, the ink is discharged, may be employed.

What is claimed is:

1. A liquid discharging apparatus, comprising:

a discharging portion which discharges liquid;

a carriage which has the discharging portion mounted thereon, and is provided with a conductive member;

a power supply source which supplies power for discharging the liquid from the discharging portion;

a housing which has the power supply source installed therein; and a carriage guide axis which supports the carriage to be movable with respect to the housing, wherein, between the carriage guide axis and the conductive member, a coupling capacitance is formed by electric field coupling, and wherein the coupling capacitance is included in a power supplying path to the discharging portion or a discharging path from the discharging portion, in a transmission path of the power.

2. The liquid discharging apparatus according to claim 1, wherein, between the carriage guide axis and the conductive member, at least liquid or solid which has higher permittivity compared to air is provided.

3. The liquid discharging apparatus according to claim 1, wherein the carriage guide axis has a substantially cylindrical shape, and wherein the conductive member includes a surface which has a circular arc shape along an outer circumferential surface of the carriage guide axis when viewed from an axial direction of the carriage guide axis.

4. The liquid discharging apparatus according to claim 1, wherein the conductive member has a substantially planar shape, and wherein the carriage guide axis includes a plane which faces the conductive member.

5. The liquid discharging apparatus according to claim 1, wherein, as the carriage guide axis, a first carriage guide axis which forms the coupling capacitance included in the power supplying path, and a second carriage guide axis which forms the coupling capacitance included in the discharging path, are provided, and wherein, as the conductive member, a first conductive member which forms the coupling capacitance by electric field coupling between the first carriage guide axis and the first conductive member, and a second conductive member which forms the coupling capacitance by electric field coupling between the second carriage guide axis and the second conductive member, are provided.

6. The liquid discharging apparatus according to claim 1, wherein the carriage includes a head which has the discharging portion, and a head information managing portion which manages head information according to the head, wherein the housing includes a control portion which generates a control signal that controls the discharge of the liquid, and a control signal transmitting portion which wirelessly transmits the control signal to the head, and wherein the head information is transmitted to the control portion from the head information managing portion, via the coupling capacitance.

7. A control method of a liquid discharging apparatus, which includes a discharging portion which discharges liquid, a carriage which has the discharging portion mounted thereon, and is provided with a conductive member, a power supply source which supplies power for discharging the liquid from the discharging portion, a housing which has the power supply source installed therein, and a carriage guide axis which supports the carriage to be movable with respect to the housing, a method, comprising:

forming a coupling capacitance by electric field coupling between the carriage guide axis and the conductive member;

transmitting the power to the discharging portion via the coupling capacitance; and discharging the liquid from the discharging portion by the transmitted power.

* * * * *